US012565813B2

(12) United States Patent
Kumbhar et al.

(10) Patent No.: US 12,565,813 B2
(45) Date of Patent: Mar. 3, 2026

(54) APPARATUS TO CONNECT CABLES INSIDE COILED TUBING AND CONNECT COILED TUBING

(71) Applicant: Halliburton Energy Services, Inc., Houston, TX (US)

(72) Inventors: Koustubh Kumbhar, Spring, TX (US); Harley Wayne Jones, Duncan, OK (US); Earl Don Webb, Wilson, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/749,326

(22) Filed: Jun. 20, 2024

(65) Prior Publication Data

US 2025/0389160 A1 Dec. 25, 2025

(51) Int. Cl.
*E21B 17/02* (2006.01)
*E21B 17/04* (2006.01)

(52) U.S. Cl.
CPC ..... *E21B 17/023* (2013.01); *E21B 17/028* (2013.01); *E21B 17/041* (2020.05)

(58) Field of Classification Search
CPC ..... E21B 17/028; E21B 17/206; E21B 17/023
See application file for complete search history.

(56) References Cited

U.S. PATENT DOCUMENTS 3,378,811 A 4/1968 Cullen et al.
6,298,921 B1 10/2001 Kobylinski
8,281,851 B2 10/2012 Spence
8,875,791 B2 11/2014 Erkol
10,544,632 B2 1/2020 O'Grady
2008/0159077 A1 7/2008 Madhavan et al.
2009/0229817 A1 9/2009 Partouche et al.
2015/0162730 A1* 6/2015 D'Silva ..... E21B 17/003 174/68.3
2019/0316425 A1 10/2019 Wisinger, Jr. et al.

OTHER PUBLICATIONS

International Search Report and Written Opinion dated Mar. 19, 2025 for related PCT Application No. PCT/ US2024/038131 filed Jul. 16, 2024.

* cited by examiner

*Primary Examiner* — Giovanna Wright
(74) *Attorney, Agent, or Firm* — K&L Gates LLP

(57) ABSTRACT

A coiled tubing system includes sections of coiled tubing that include an electrical cable and at least one electrical male wet stab connector. Each male connector includes a male fluid pathway and secures a section of electrical cable such that the electrical cable is isolated from the male fluid pathway. The system also includes a female tubing crossover configured to connect two sections of coiled tubing and including a female fluid pathway and electrical female wet stab connectors. The female connectors are each configured to receive a respective male connector to establish an electrical connection with the electrical cables that is isolated from the female fluid pathway. Each respective male fluid pathway and the female fluid pathway are in fluid communication when the female tubing crossover is connecting two sections of the coiled tubing to provide fluid communication between the sections of coiled tubing.

20 Claims, 26 Drawing Sheets

APPARATUS TO CONNECT CABLES INSIDE COILED TUBING AND CONNECT COILED TUBING

BACKGROUND

Coiled tubing is used to communicate fluids and electricity between a bottom hole assembly "BHA" of a drilling system and the above ground systems of the drilling operation. Coiled tubing has a fluid path defined within the tubing, where an internal electrical cable may also disposed. The electrical cable is isolated from a fluid flow via sheathing or cable insulation, as contact between the electrical cable and a fluid could communicate electric current into the fluid, and the fluid could impair the conduction of electricity along the cable. In a continuous length of coiled tubing, the isolation of the electric current flow and the fluid flow is achieved by insulating the electrical cable in a protective sheathing. However, when two lengths of coiled tubing must be connected, the electrical cables must be exposed from the protective sheathing such that a connection may be formed, and then the electrical cables and the connection therebetween must be re-sheathed prior to the tubes of the coiled tubing being connected. This process can be arduous, involve many steps, devices, tools and require many man hours to achieve.

DETAILED DESCRIPTION

Figure 1A:
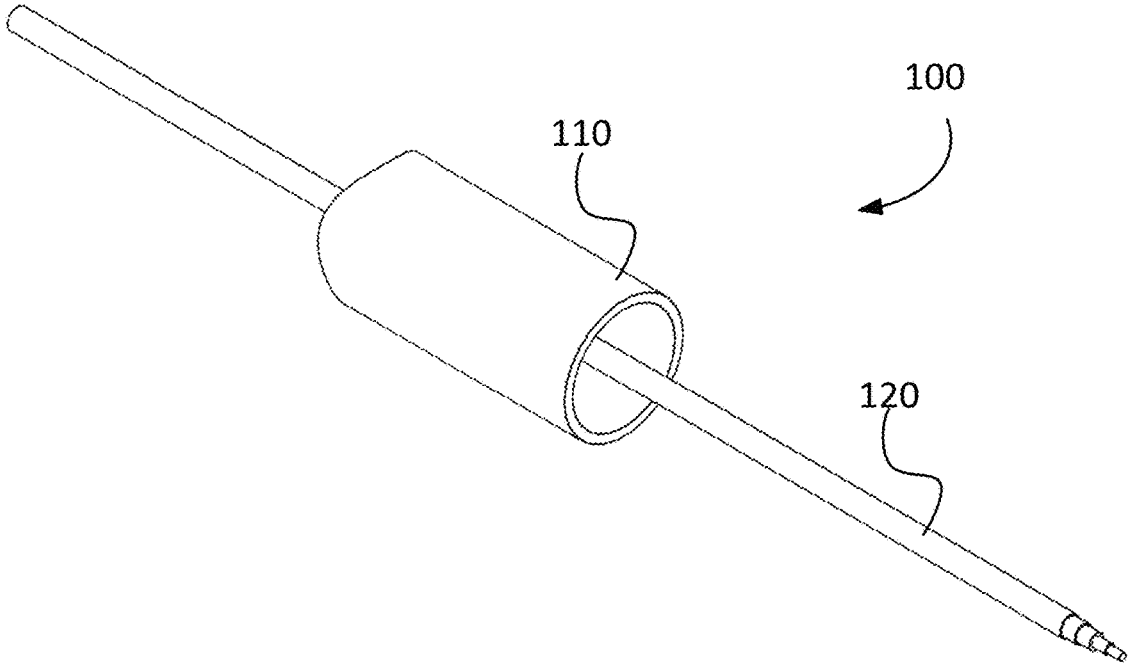
FIG. 1A illustrates a coiled tubing section and FIG. 1B illustrates a cross-sectional view of the same, according to one or more embodiments.

The devices and systems of the present disclosure provide a "quick connect" wet stab connection system to connect sections of coiled tubing. The connection system also electrically connects internal electrical cables within the sections while isolating a fluid pathway inside the coiled tubing from electrical contact with the electrical cables. The system includes an electrical male wet stab connector (herein after "male connector") on the end of each section of coiled tubing. A female tubing crossover includes two electrical female wet stab connectors (herein after "female connector") on the ends, such that the female connectors of the female tubing crossover interface with two respective male connectors of different sections of coiled tubing, thereby providing a fluid connection and an electrical connection between two sections of coiled tubing through the female tubing crossover. For purposes of this disclosure, the male and female electrical wet stab connectors may be wet-mateable or dry-mateable and both are designed to isolate the electrical connection from a wet surrounding environment. The female tubing crossover is also configured to facilitate fluid flow and an electrical connection between a section of coiled tubing and a BHA including a male connector, thus establishing fluid and electrical communication with the BHA through the coiled tubing.

The male connector also secures the electrical cable within a section of coiled tubing with the electrical cable terminating in the male connector to be electrically connectable with the female connector. The female connector is configured to receive the male connector when the male connector and the female connector are engaged to form an electrical connection. The male connector includes a male fluid pathway that is physically isolated from the electrical cable and the female connector likewise includes a female fluid pathway that is physically isolated from the electrical cable. The male connector and the female connector are connectable such that the male fluid pathway and the female fluid pathway are aligned to form a fluid connection between the female tubing crossover and the coiled tubing.

The female tubing crossover is further configured to interface with a second section of coiled tubing on an opposite side and in the same manner, such that the female fluid pathway is aligned with two male fluid pathways of the two male connectors and the two male fluid pathways are in fluid communication via the female fluid pathway. An electrical connection is provided between two female connectors within the female tubing crossover, such that the two male connectors may be electrically connected therethrough when two sections of coiled tubing are mutually engaged with a female tubing crossover.

A section of coiled tubing may also be connectable with a BHA via a female connector affixed to the BHA. The BHA female connector is connectable with a male connector and is configured to provide an electrical connection and a fluid pathway from the section of coiled tubing to the BHA. The BHA female connector may be hard-wired into the electrical system of the BHA to establish the electrical connection.

Alternatively, the BHA may include a male connector connectable with a female tubing crossover and configured to provide an electrical connection and a fluid pathway from the female tubing crossover to the BHA. The BHA male connector may be hard-wired to the electrical system of the BHA to establish the electrical connection.

Furthermore, the connection system is configured to be rapidly and easily connectible. The male connectors are configured to be easily inserted into the female connectors and secured, potentially reducing man hours and manual labor requirements for drilling.

In this disclosure, some fluid pathways, and electrical connections are described and referred to as "physically isolated" from one another. As used herein, "physically isolated" is understood to indicate that the conductive portions of the components forming electrical connections are not exposed to the fluid pathways and are thus not substantially affected by fluids which may be flowing in the various described fluid pathways.

Various possible configurations of the system may include several of the above-mentioned components, and other possible configurations may omit one or more of the above-mentioned components without departing from the scope of the disclosure.

Figure 1B:
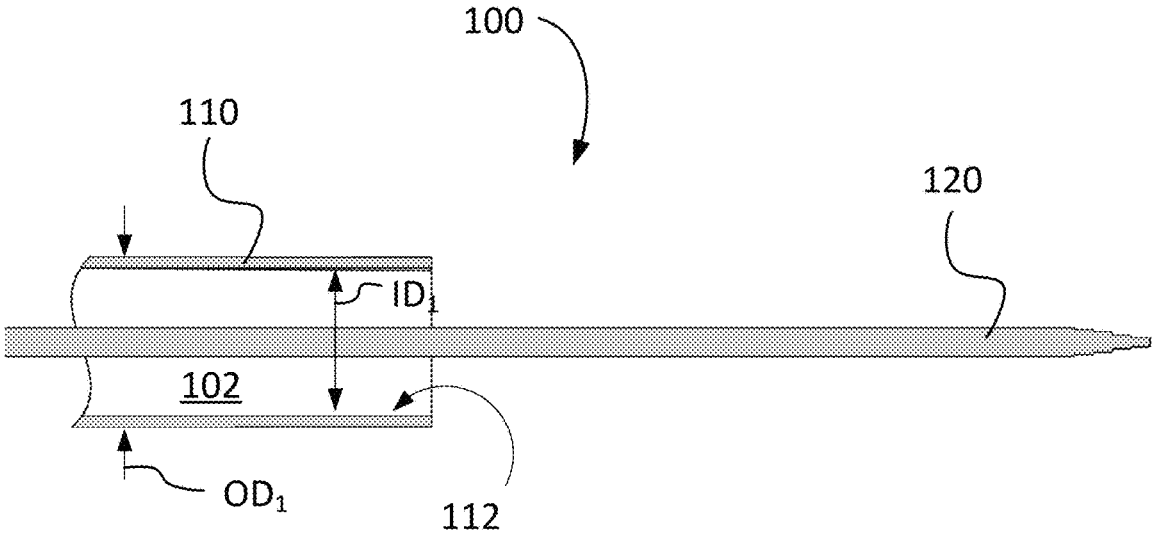

FIG. 1A illustrates a section of coiled tubing 100 including a tubing 110 and an electrical cable 120, and FIG. 1B illustrates a cross-sectional view of the same, according to one or more embodiments. The coiled tubing 100 is composed of a tubing 110, which may be a flexible metal pipe or similar structure, defining a tube internal bore 102 and having a tube internal surface 112. An electrical cable 120 is disposed within the tube internal bore 102 and extends through the tubing 110. The first internal diameter $ID_1$ and first external diameter $OD_1$ of the tubing 110 may vary between embodiments. The tube internal bore 102 defines a fluid pathway through the coiled tubing 100 (e.g., which may be used to provide fluid communication between a BHA and a surface operation), and the electrical cable 120 provides an electrical connection through the coiled tubing (e.g., which may be used to provide electrical communication between the BHA and drilling operation and power equipment at the surface).

The electrical cable 120 may include sheathing (e.g., insulation) which prevents contact between wires contained in the electrical cable 120 and a fluid which may be flowing the in the fluid pathway of the coiled tubing 100. Said differently, the sheathing of the electrical cable 120 may physically isolate the electric current(s) (e.g., electrical connection) within the electrical cable 120 from the fluid pathway of the coiled tubing 100.

According to one or more embodiments, the electrical cable 120 may be a concentric cable having several distinct and mutually insulated concentric wire paths providing respectively separate electrical currents or signals. Further contemplated are embodiments where the electrical cable 120 includes several parallel wire paths, or a single wire path.

Figure 2:
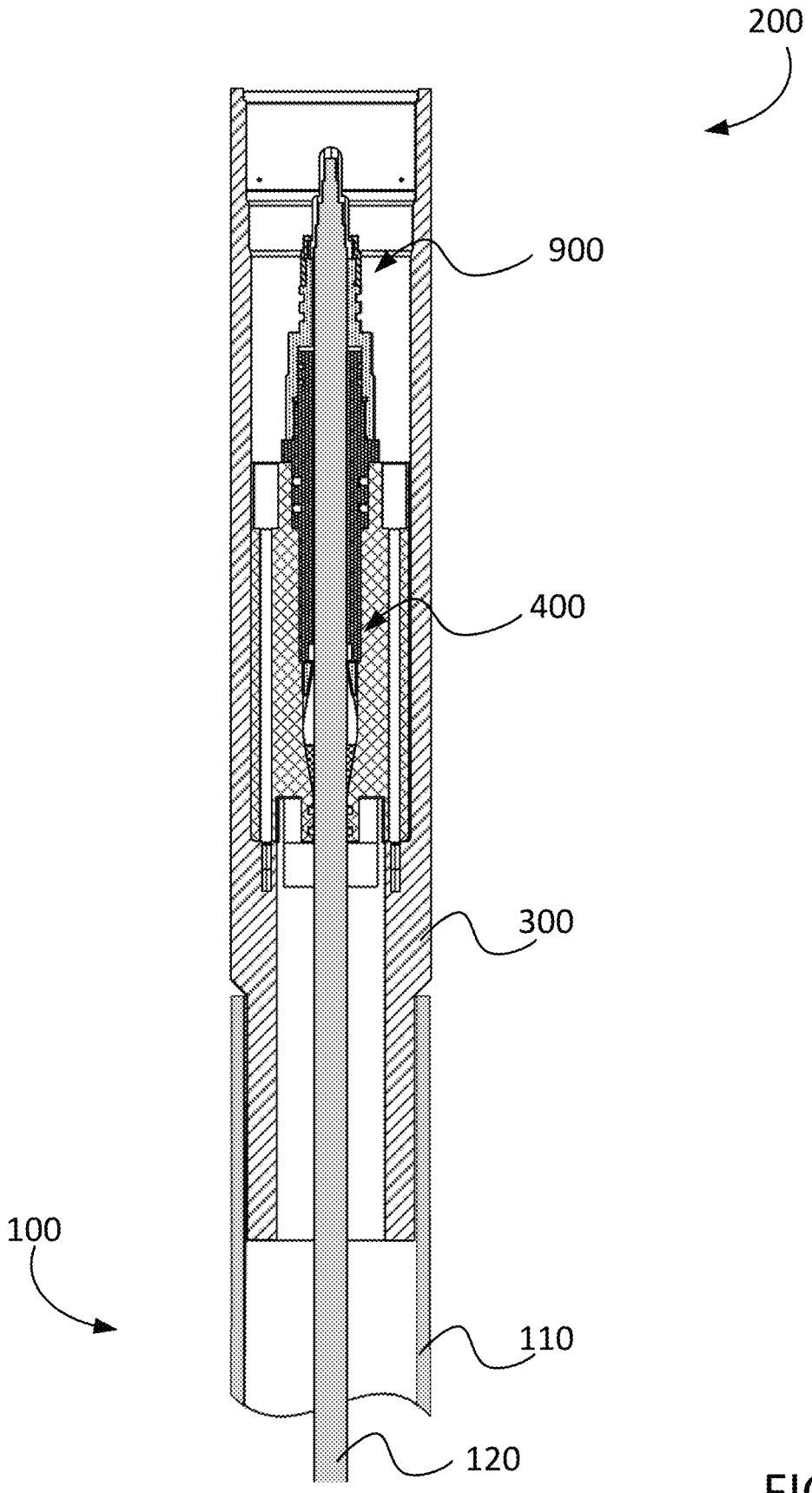
FIG. 2 illustrates a male connector engaged with the coiled tubing section of FIGS. 1A and 1B, according to one or more embodiments.

FIG. 2 illustrates a cross-sectional view of a male connector 200 at the end of a section of coiled tubing 100, including a male housing 300, an anchor 400 (see FIG. 4), and a stab section 900, according to one or more embodiments. The anchor 400 secures the electrical cable 120 within the male housing 300, and the stab section 900 is secured to a portion of the electrical cable that extends through the anchor 400 and is electrically connected thereto. The male connector 200 includes a male fluid pathway alignable with the female fluid pathway of a female connector of a female tubing crossover 1300 (see FIG. 13), and alternatively with the BHA fluid pathway of a female connector 1900 (see FIG. 19) of a BHA. The section of coiled tubing 100 is connectable with the female tubing crossover 1300 such that an electrical connection is formed therebetween. Alternatively, the male connector 200 of the section of coiled tubing 100 is connectable with the BHA female connector 1900 such that an electrical connection is formed therebetween. Various design and functional aspects of the male connector 200 are described in greater detail in the following discussion of FIGS. 3A-12B in which the constituent components of the male connector 200 are described.

FIGS. 3A-12B illustrate various constituent components of the male connector 200, according to one or more embodiments. While illustrated as separable or otherwise distinct from one another, this disclosure contemplates embodiments where two or more of the components illustrated in FIGS. 3A-12B are integrated into single or unitary components. Also contemplated are embodiments where individual components may be configured into two or more components capable of serving the same function.

Figure 3A:
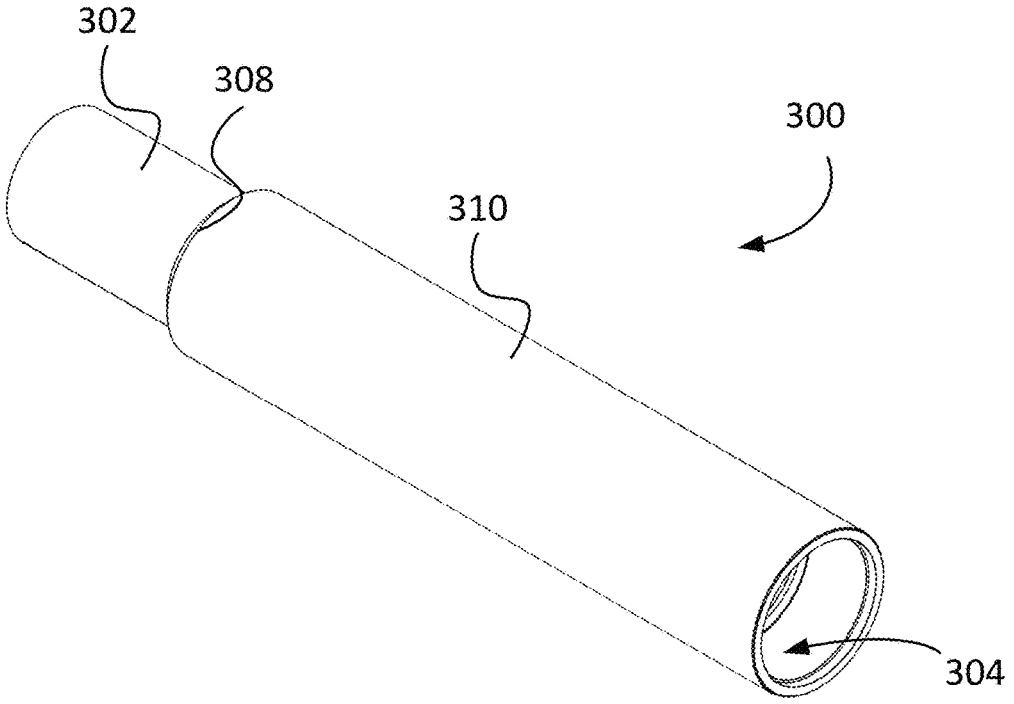
FIG. 3A illustrates a male connector housing.
Figure 3B:
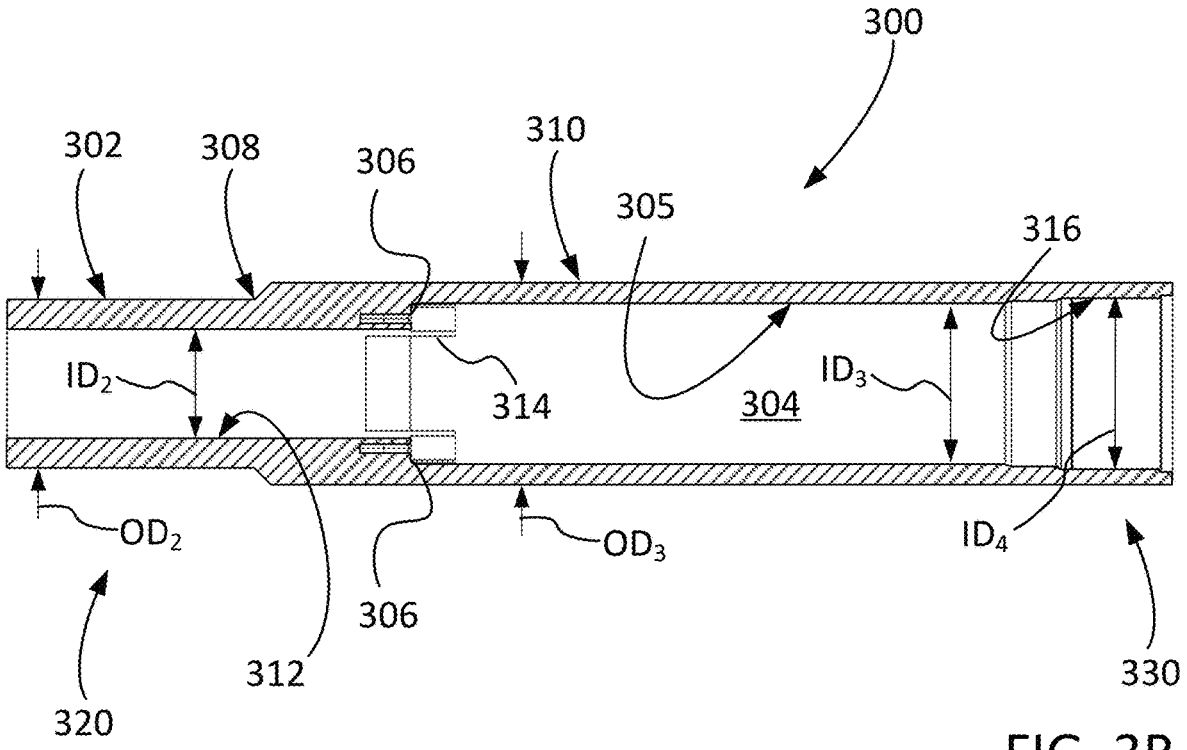
FIG. 3B illustrates a cross-sectional view of the same, according to one or more embodiments.

FIG. 3A illustrates a male housing 300 of the male connector 200 and FIG. 3B illustrates a cross-sectional view of the same, according to one or more embodiments. The male housing 300 may be substantially tubular (e.g. cylindrical) and includes a housing internal bore 304 forming an inner surface, a tubing end 320 configured to interface with the coiled tubing 100, and a connector end 330 configured to interface with a female tubing crossover 1300 (see FIG. 13) or BHA (see FIG. 19).

A first housing external surface 302 is located at the tubing end 320 of the male housing 300 and has a second external diameter $OD_2$ that is matched with first internal diameter $ID_1$ of the tubing 110, such that the tubing end 320 of the male housing 300 is insertable into the tubing 110 and the tube internal surface 112 interfaces (e.g., abuts, slots) with the first housing external surface 302 and the electrical cable 120 passes through the housing internal bore 304. When affixing the male housing 300 to the coiled tubing 100, the first housing external surface 302 and the tube internal surface 112 may be welded, bonded, fastened, fitted, or otherwise joined together to form a secure connection. The first housing external surface 302 and a second housing external surface 310 may be separably defined by a lip 308 (e.g., flange) which may define an extent to which the male housing 300 may be inserted into the tubing 110, as the third external diameter $OD_3$ of the second housing external surface 310 is greater than the first internal diameter $ID_1$ of the coiled tubing 100, such that the male housing 300 is prevented from insertion into the tubing 110 past the point where the lip 308 abuts an edge of the tubing 110.

A first section of the housing internal bore 304 is formed by a first housing internal surface 312 having a second internal diameter $ID_2$, which is defined at the tubing end 320 and is bounded by a housing flange 314. The housing flange 314 is configured such that when an anchor 400 (see FIG. 4) is inserted (e.g., via the connector end 330) into the male housing 300, the anchor 400 abuts the housing flange 314, which may include housing fastener holes 306 to facilitate attachment of the anchor 400 (e.g., with fasteners). In some examples, the second internal diameter $ID_2$ of the first housing internal surface 312 is of sufficient gauge that the electrical cable 120 may be extended therethrough while retaining sufficient space to support fluid communication through the same.

A second portion of the housing internal bore 304 is formed by a second housing internal surface 305 disposed to the side of the housing flange 314 towards the connector end 330 and has a third internal diameter $ID_3$, which is greater than the second internal diameter $ID_2$. The second housing internal surface 305 is configured to interface with the bracing surfaces 504 of an anchor manifold 500 (see FIGS. 5A and 5B).

Figure 19:
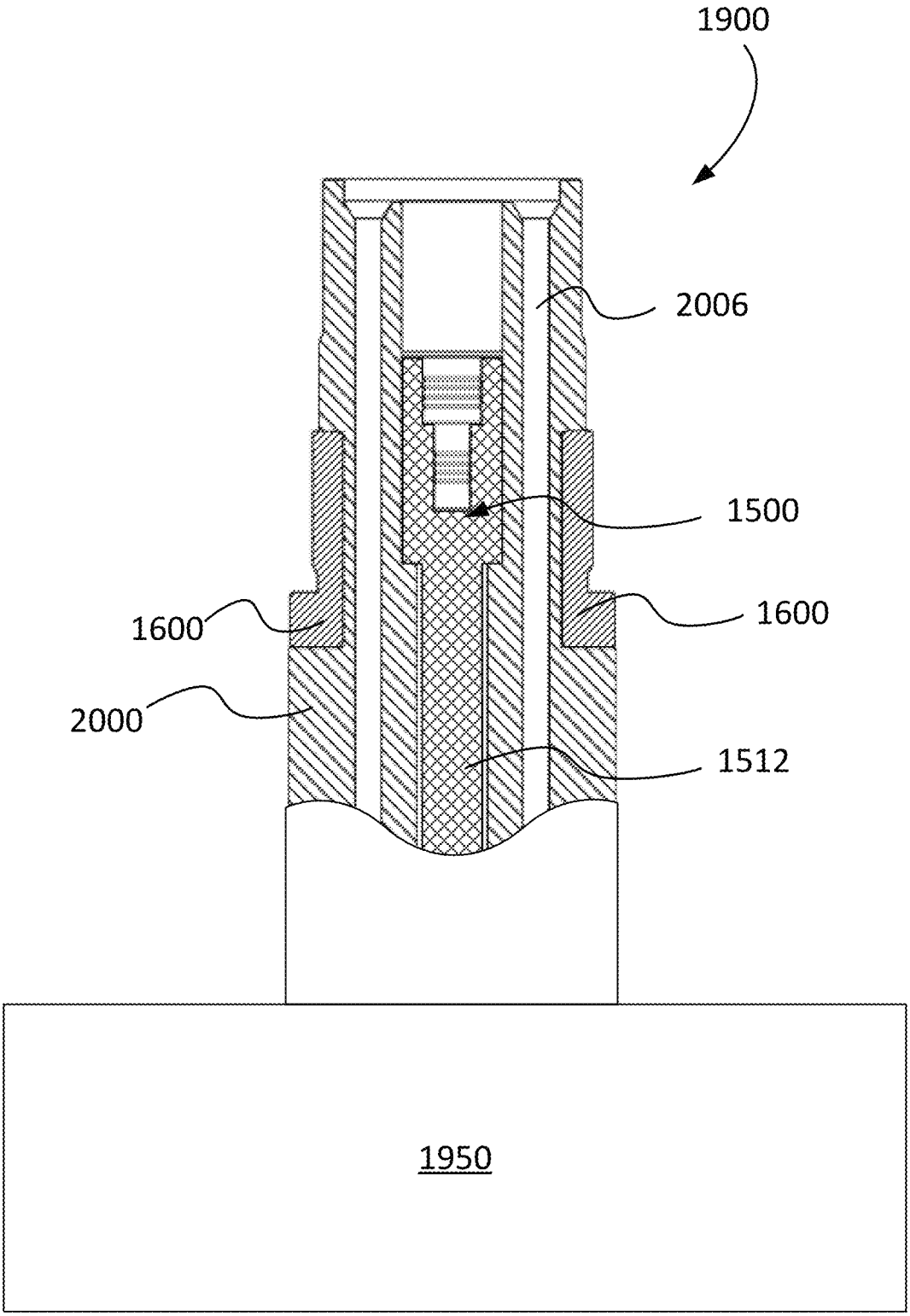
FIG. 19 illustrates a cross-sectional view of a BHA female connector, according to one or more embodiments.

A third portion of the housing internal bore 304 is provided by a third housing internal surface 316 having a fourth internal diameter $ID_4$, which may be configured to interface with a fastening ring 1600 (see FIGS. 16A and 16B) of a female tubing crossover 1300 (see FIG. 13) or a female connector 1900 of a BHA (see FIG. 19). In some examples, the housing internal bore 304 may include one or more stepped, or progressively graduated surfaces between the second housing internal surface 305 and the third housing internal surface 316.

According to one or more embodiments, the male housing 300 may be manufactured via additive manufacture (e.g. 3D printing) or subtractive manufacture (e.g., CNC milling). The male housing may also have a metal construction (e.g. steel, etc.).

Figure 4:
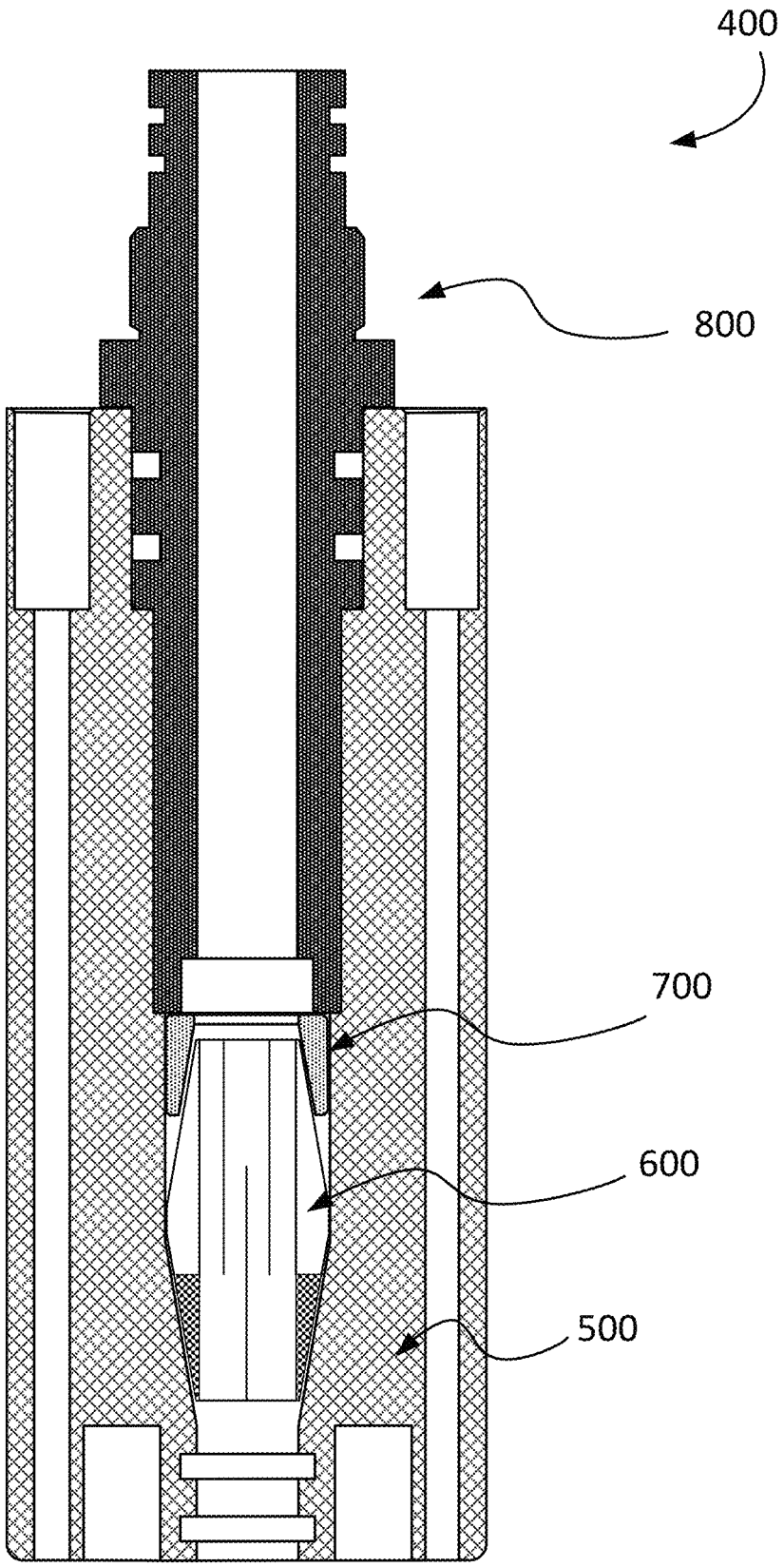
FIG. 4 illustrates an anchor, according to one or more embodiments.

FIG. 4 illustrates an anchor 400, including an anchor manifold 500, a collet 600, a collet cone 700 and a sealing component 800, according to one or more embodiments. The anchor 400 is insertable into the male housing 300 (via the connector end 330) and securable thereto. When the male connector 200 is affixed to the section of coiled tubing 100, the electrical cable 120 extends through the housing internal bore 304 and is secured in the male connector 200 by the anchor 400. Furthermore, the anchor 400 defines a portion of the male fluid pathway through the male connector 200 and may serve as a platform for attachment of the stab section 900 (see FIG. 9) to the electrical cable 120.

Figure 5A:
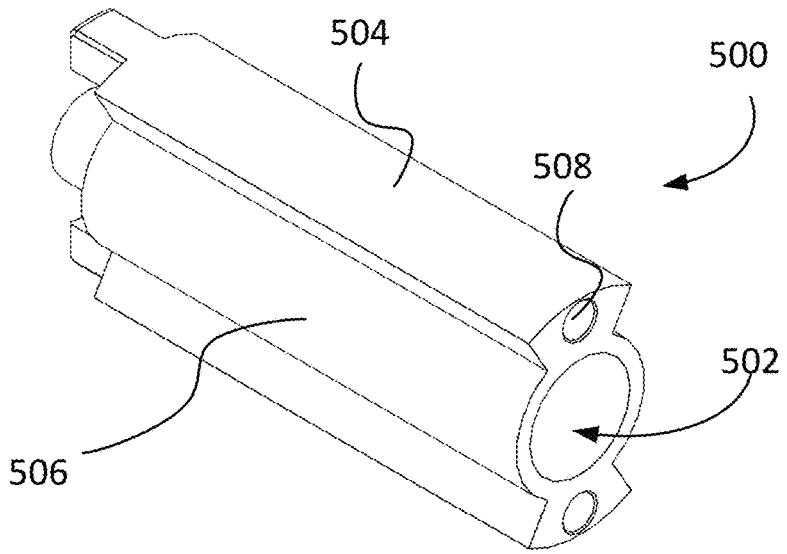
FIG. 5A illustrates an anchor manifold.
Figure 5B:
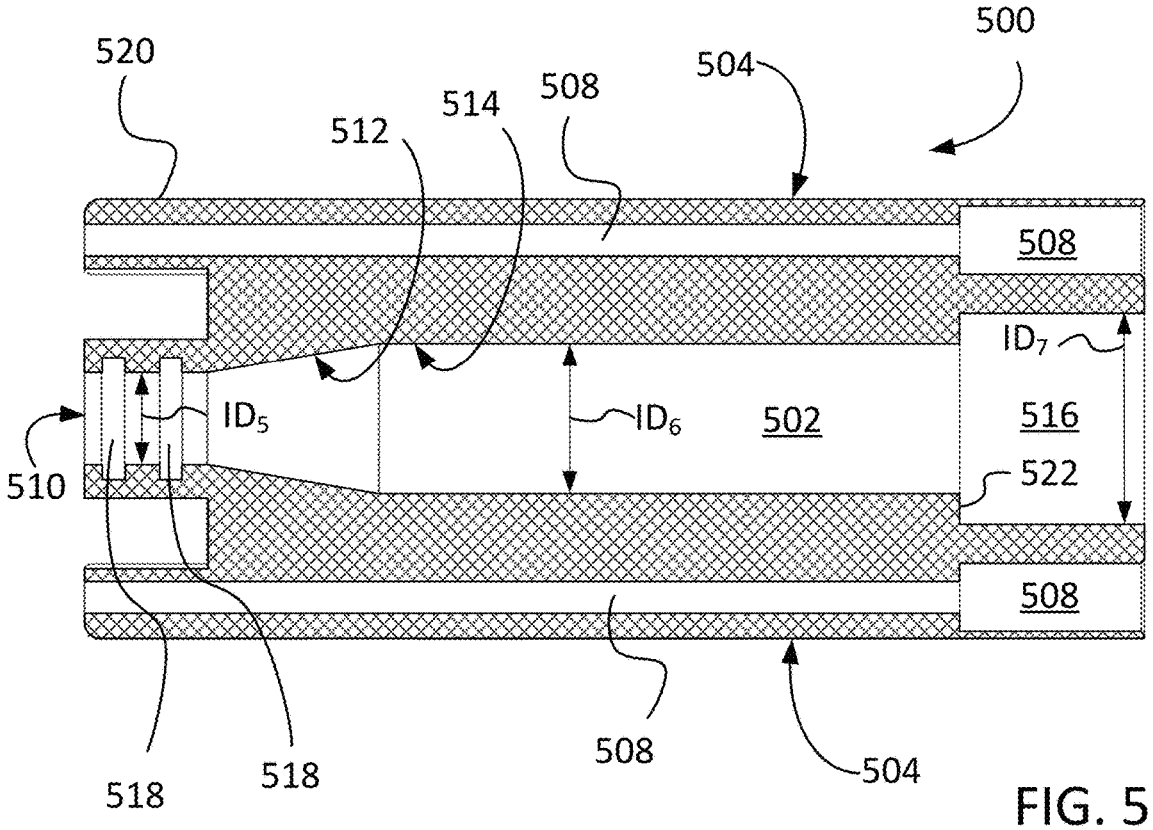
FIG. 5B illustrates a cross-sectional view of the same, according to one or more embodiments.

FIG. 5A illustrates an anchor manifold 500 of the anchor 400 and FIG. 5B illustrates a cross-sectional view of the same, according to one or more embodiments. The anchor manifold 500 includes an anchor internal bore 502, bracing surfaces 504, and may include side channels 506.

The anchor internal bore 502 is defined through the anchor manifold 500 between a cable inlet 510 and a seal orifice 516. The anchor internal bore 502 is configured such that a portion of the electrical cable 120 may be extended therethrough. A first portion of the anchor internal bore 502 is formed by the cable inlet 510, which has a fifth internal diameter $ID_5$ matched to the gauge of the electrical cable 120, within tolerances. In some examples, the cable inlet 510 includes O-ring slots 518, which are circumferentially defined about the cable inlet 510 and configured to house O-ring seals, such that when the electrical cable 120 is extended through the anchor 400, the O-rings form a seal between the cable inlet 510 and the electrical cable 120, such that fluids present in the coiled tubing 100 and the male connector 200 are substantially prevented from entering the anchor internal bore 502. As illustrated, the cable inlet 510 includes two O-ring slots 518, however other quantities of O-ring slots 518 are contemplated.

A second portion of the anchor internal bore 502 is formed by an anchor conic surface 512, which graduates anchor internal bore 502 from the fifth internal diameter $ID_5$ of the cable inlet 510 to the sixth internal diameter $ID_6$ of the first anchor internal surface 514. The anchor conic surface 512 is configured to interface with a collet 600 (see FIGS. 6A and 6B)

A third portion of the anchor internal bore 502 is formed by the seal orifice 516 having a seventh internal diameter $ID_7$. The seal orifice 516 may formed by a counterbore of the anchor internal bore 502, such that an anchor flange 522 delineates the transition between the first anchor internal surface 514 and the seal orifice 516. In some examples, seal orifice 516 interfaces with the sealing component 800, such that the sealing component 800 abuts the anchor flange 522.

The anchor manifold 500 includes bracing surfaces 504 which are configured to interface with the second housing internal surface 305 of the male housing 300. Although two bracing surfaces are shown, the manifold may possibly have one or more than two bracing surfaces 504. The bracing surfaces 504 are rounded surfaces matched to the second housing internal surface 305 of the male housing 300, which may be installed via a press fit (e.g., interference fit). In some examples, the bracing surfaces 504 are threaded, and the second housing internal surface 305 is compatibly threaded, such that the anchor manifold 500 may be secured into the male housing 300 via threading the anchor manifold 500 into place. The anchor manifold 500 may be installed into the housing internal bore 304 of the male housing 300 via the connector end 330 to a point such that the anchor manifold 500 abuts the housing flange 314. In one or more embodiments, the anchor manifold 500 includes anchor fastener through holes 508 that are alignable with the housing fastener holes 306 when the anchor manifold 500 abuts the housing flange 314, such that the anchor manifold 500 is securable to the male housing 300 via fasteners inserted through the anchor fastener through holes 508 into the housing fastener holes 306. In one or more embodiments the anchor manifold 500 includes tabs 520, which are configured to align with slots inlaid into the housing flange 314 of the male housing 300, such that the tabs 520 and the slots in the housing flange 314 interlock and block the anchor 400 from rotating within the male housing 300, and block the anchor manifold 500 from translating through the housing internal bore 304 when secured. Although illustrated as to be compatible with fasteners, this disclosure further contemplates embodiments where the male housing 300 and anchor manifold 500 are a single integrated component.

The anchor manifold 500 also includes two side channels 506, which, in conjunction with the second housing internal surface 305, form the male fluid pathway through the male housing 300 around the anchor manifold 500. The portion of the male fluid pathway formed by the side channels 506 is physically isolated from the anchor internal bore 502. In some examples, the bracing surfaces 504 are unified in a cylindrical manner about the anchor manifold 500, forming a single bracing surface 504, such that the anchor manifold 500 is a cylinder. In such embodiments, the side channels 506 are forgone in favor of internal fluid bores, which pass through the body of the anchor manifold 500 to define the portion of the male fluid pathway and are physically isolated from the anchor internal bore 502.

Figure 6A:
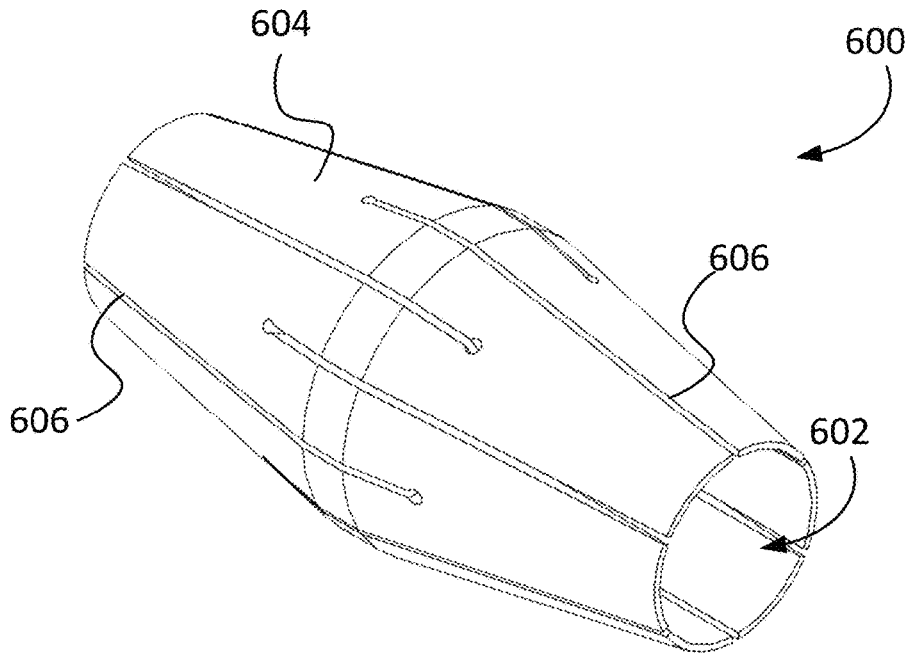
FIG. 6A illustrates a collet.
Figure 6B:
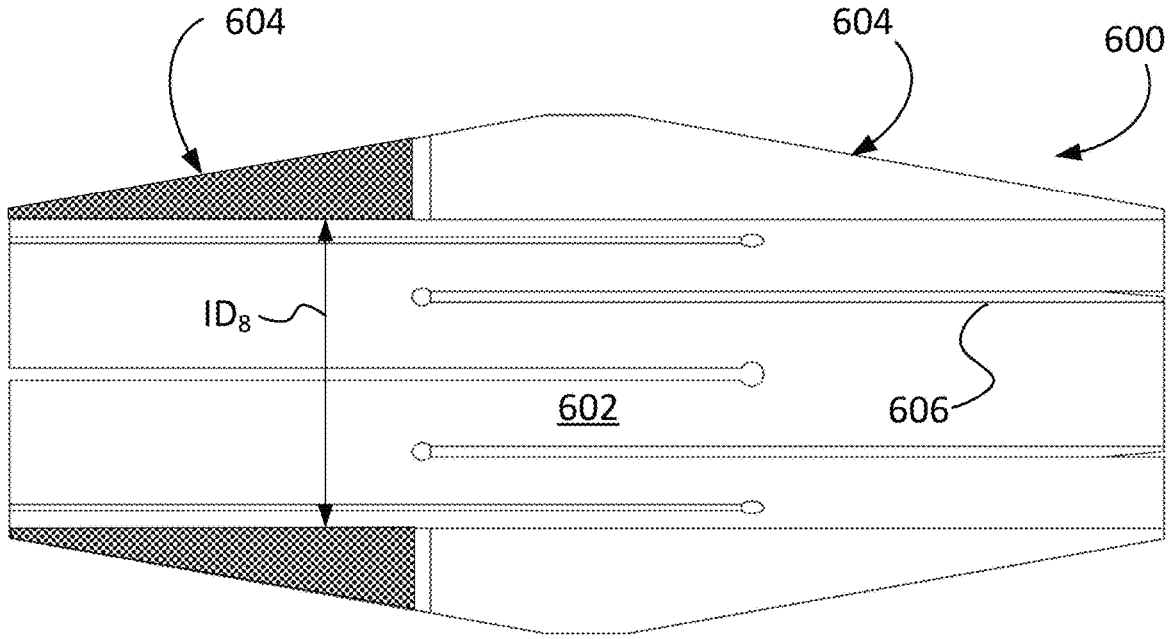
FIG. 6B illustrates a cross-sectional view of the same, according to one or more embodiments.

FIG. 6A illustrates a collet 600 and FIG. 6B illustrates a cross-sectional view of the same, according to one or more embodiments. The collet 600 is insertable into the anchor internal bore 502 over the portion of electrical cable 120 extending therethrough, such that the collet 600 abuts and interfaces with the anchor conic surface 512. The collet 600 includes collet conic surfaces 604 which are configured to interface with the anchor conic surface 512, and the cone conic surface 704 of the collet cone 700 (see FIGS. 7A and 7B). The collet conic surfaces 604 include several kerf cuts 606, which allow the collet internal bore 602 to decrease to an eighth internal diameter $ID_8$ when a compressive force is applied to the collet conic surfaces 604. Thus, when the collet 600 is disposed about the electrical cable 120 and a compressive force is applied to the collet conic surfaces 604, the collet 600 exerts a radially compressive force on the electrical cable 120.

Figure 7A:
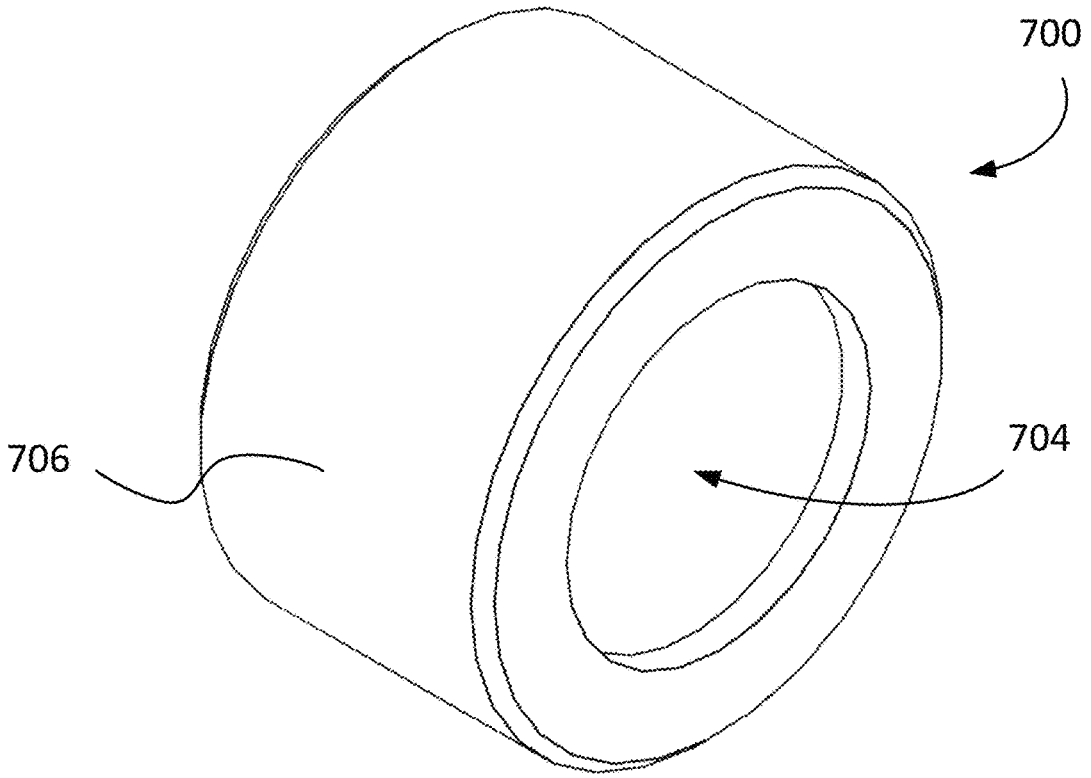
FIG. 7A illustrates a collet cone.
Figure 7B:
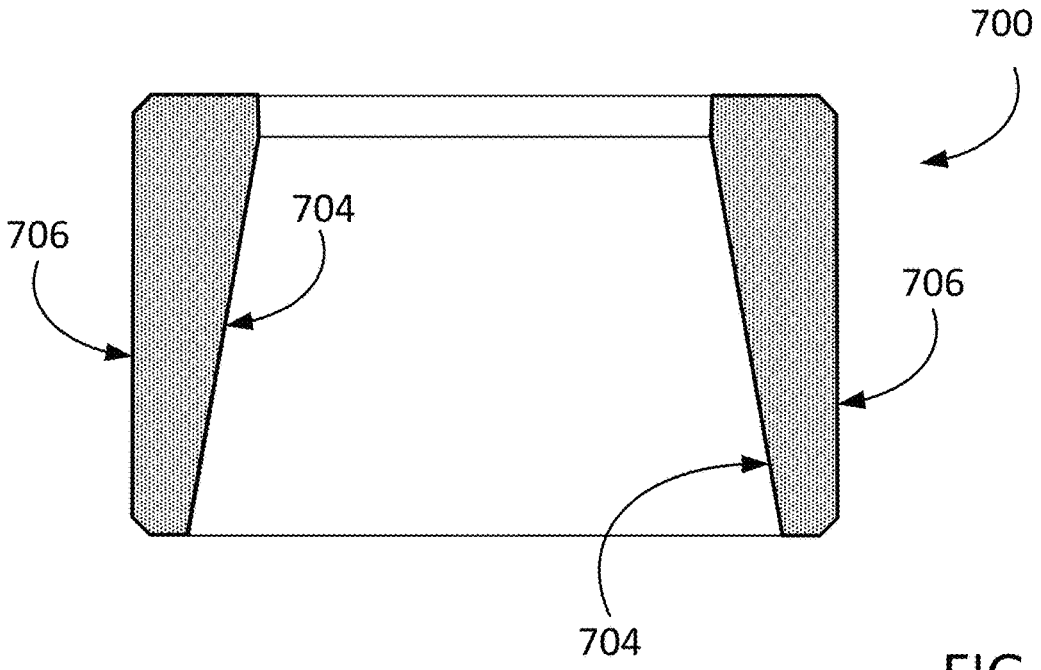
FIG. 7B illustrates a cross-sectional view of the same, according to one or more embodiments.

FIG. 7A illustrates a collet cone 700 and FIG. 7B illustrates a cross-sectional view of the same, according to one or more embodiments. The collet cone 700 includes an external cylindrical surface 706, and a cone conic surface 704. The external cylindrical surface 706 is matched with the first anchor internal surface 514 of the anchor manifold 500. The collet cone 700 is configured such that the collet cone 700 may be inserted over a portion of the electrical cable that extends through the anchor 400 into the anchor internal bore 502, subsequently to abut the collet 600, where the cone conic surface 704 of the collet cone 700 interfaces with a collet conic surface 604. The collet cone 700 may be biased towards the anchor conic surface 512 with the collet 600 disposed in between, such that the anchor conic surface 512 and the cone conic surface 704 apply a radially compressive force on the collet 600, which in turn induces the collet to apply a radially compressive force onto the electrical cable 120 extending therethrough, which may provide sufficient friction force to prevent the electrical cable 120 from translating through the collet 600.

Alternatively, the anchor manifold 500 may not include an anchor conic surface 512, and instead include a flange. In this manner, a second collet cone 700 may be employed where the cone conic surface 704 of the second collet cone 700 is opposed to the cone conic surface 704 of the first collet cone 700. The flange biases the second collet cone 700 such that the collet 600 may be compressed between the opposed cone conic surfaces 704.

Figure 8A:
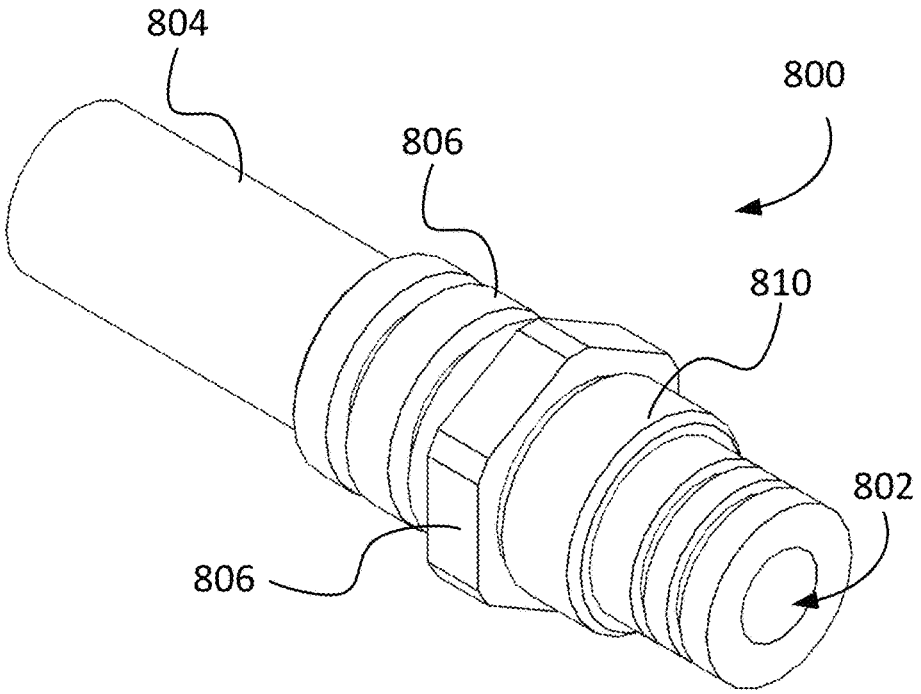
FIG. 8A illustrates a sealing component and FIG. 8B illustrates a cross-sectional view of the same, according to one or more embodiments.
Figure 8B:
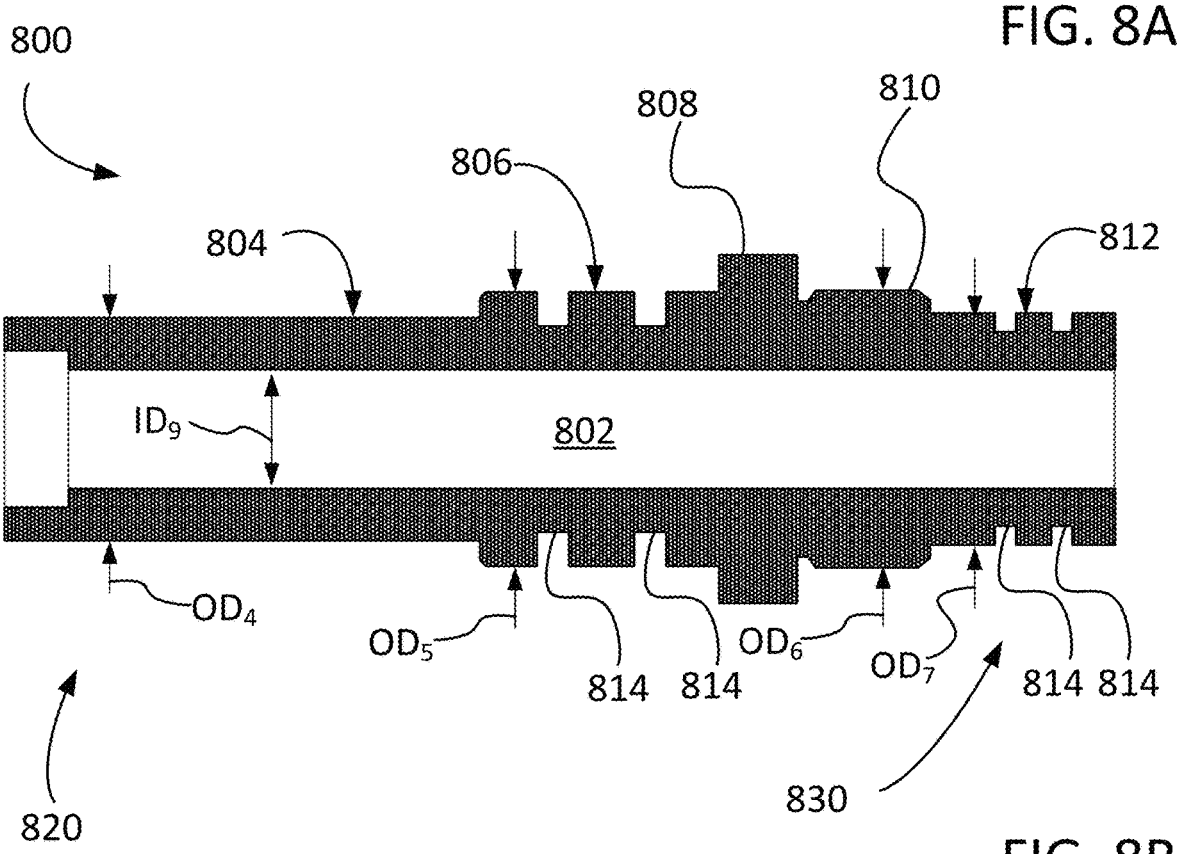

FIG. 8A illustrates a sealing component 800, and FIG. 8B illustrates a cross-sectional view of the same, according to one or more embodiments. The sealing component 800 has an anchor end 820 and a connector end 830. The anchor end 820 is configured to be insertable into the anchor internal bore 502, and the connector end 830 is configured to protrude from the anchor manifold 500 and provide a basis of attachment for the stab section 900. The sealing component 800 is substantially tubular and includes several stepped surfaces of varying diameters, (e.g., a first seal external surface 804 having a fourth external diameter $OD_4$, a second seal external surface 806 having a fifth external diameter $OD_5$, a seal flange 808, a third seal external surface 810 having a sixth external diameter $OD_6$, and a fourth seal external surface 812 having a seventh external diameter $OD_7$).

The sealing component 800 is used to apply a biasing force on the collet cone 700 when the sealing component 800 is inserted into the anchor internal bore 502 of the anchor manifold 500. The biasing force compresses the collet 600 between the collet cone 700 and the anchor conic surface 512 of the anchor, which results in a compressive radial force transferred to the electrical cable 120, which may restrict the electrical cable 120 from translating through the collet. As the collet 600 is wedged between the anchor conic surface 512 and the cone conic surface 704 of the collet cone 700, the collet 600 is prevented from sliding through the anchor internal bore 502. Thus, the electrical cable 120 is fixed in place with respect the male connector 200.

The fourth external diameter $OD_4$ of the first seal external surface 804 may be matched with the sixth internal diameter $ID_6$ of the first anchor internal surface 514 of the anchor internal bore 502, such that the first seal external surface 804 of the sealing component 800 is circumferentially aligned the anchor internal bore 502 when the sealing component 800 is inserted into the anchor manifold 500. In some examples the first seal external surface 804 may be threaded, and the first anchor internal surface 514 may have compatible threads, such that the sealing component 800 is securable to the anchor manifold 500 via a threaded union between the first seal external surface 804 and the first anchor internal surface 514. The threaded connection may further be employed to maintain the compressive force of the sealing component 800 on the collet cone 700, thus securing the electrical cable 120 within the anchor 400.

The sealing component 800 includes a second seal external surface 806 having a fifth external diameter $OD_5$, which is matched with the seventh internal diameter $ID_7$ of the seal orifice 516 of the anchor manifold 500. The lip between the first seal external surface 804 and the second seal external surface 806 is configured to abut the anchor flange 522 when the sealing component 800 is inserted into the anchor internal bore 502.

The second seal external surface 806 may include O-ring slots 814, which are circumferentially defined about the second seal external surface 806 and configured to house O-ring seals, such that when the sealing component 800 is inserted into the anchor manifold 500, the O-rings form a seal between the seal orifice 516 and the second seal external surface 806, such that fluids present in the coiled tubing 100 and the male connector 200 are substantially prevented from entering the anchor internal bore 502. As illustrated, the second seal external surface 806 includes two O-ring slots 814, however other quantities of O-ring slots 814 are contemplated.

According to one or more embodiments, the sealing component 800 includes a seal flange 808, which may limit the extent to which the sealing component 800 may be inserted into the anchor internal bore 502 of the anchor 400, such that the seal flange 808 abuts the outer surface of the anchor manifold 500. In some examples, the seal flange 808 has a standard hexagonal profile, such that standard tools (e.g., a wrench) may be employed to rotate (e.g., screw) the sealing component 800 into the anchor manifold 500 (e.g., in embodiments where the first seal external surface 804 and the first anchor internal surface 514 are compatibly threaded).

The sealing component 800 includes a third seal external surface 810, which is configured to mate with a first crossover internal surface 1004 of the electrical crossover 1000 (see FIGS. 10A and 10B) (e.g., via threads or interference fit). The third seal external surface 810 has a sixth external diameter $OD_6$ which is matched with the tenth internal diameter $ID_{10}$ of the first crossover internal surface 1004 of the electrical crossover 1000.

The sealing component includes a fourth seal external surface 812, which is configured to interface with the second crossover internal surface 1006 of the electrical crossover. In some examples, the fourth seal external surface 812 includes O-ring slots 814, which are circumferentially defined about the fourth seal external surface 812 and configured to house O-ring seals, such that when the stab section 900 is secured to the sealing component 800, the O-rings form a seal between fourth seal external surface 812 and the second crossover internal surface 1006, such that fluids present in the coiled tubing 100 and the male connector 200 are substantially prevented from entering the anchor internal bore 502 and the stab section 900. As illustrated, the fourth seal external surface 812 includes two O-ring slots 814, however other quantities of O-ring slots 814 are contemplated.

The sealing component 800 also includes a seal internal surface 802, which is configured such that the electrical cable 120 may be extended therethrough and has a ninth internal diameter $ID_9$, which matched to the gauge of the electrical cable 120, within tolerances.

Figure 9:
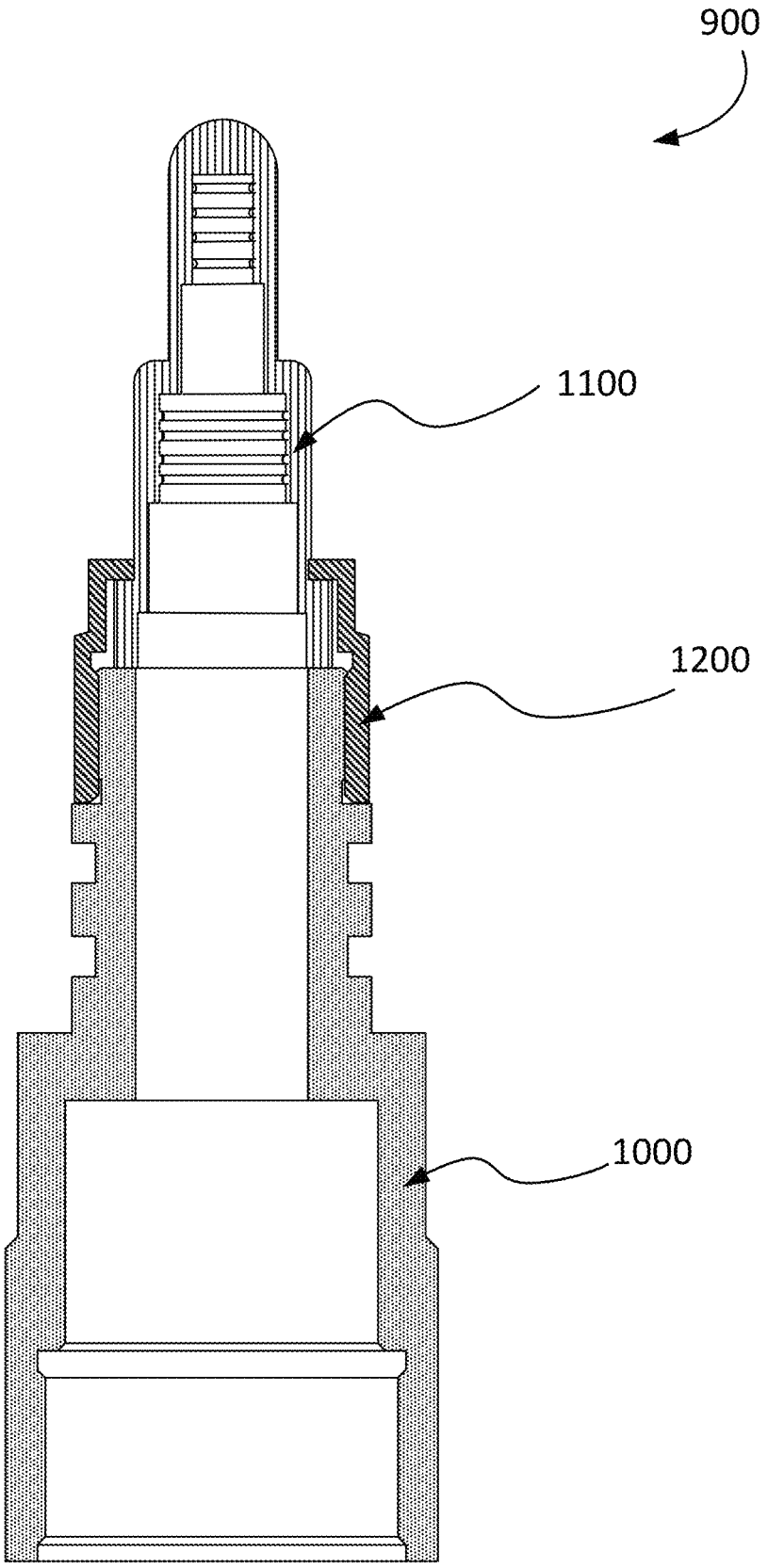
FIG. 9 illustrates a wet-mate male connector, according to one or more embodiments.

FIG. 9 illustrates a cross sectional view of a stab section 900, according to one or more embodiments. The stab section 900 includes an electrical crossover 1000, an electrical pin 1100, and a lock nut 1200. The stab section 900 is attachable to the portion of the electrical cable 120 that is extended through the anchor 400 and is securable to the sealing component 800 of the anchor 400. When attached and secured, the stab section 900 is physically and rigidly secured within the male connector 200. The stab section 900 substantially prevents the section of the electrical cable 120 that extends through the anchor 400 from contact with fluid passing through the male fluid pathway defined in the male connector 200. Furthermore, the stab section 900 is configured to be physically mateable and electrically connectable with a female receiver 1500 (see FIGS. 15A and 15B), such that electrical communication is provided from the electrical cable 120 through the male connector 200 to the female connector 1302.

Figure 10A:
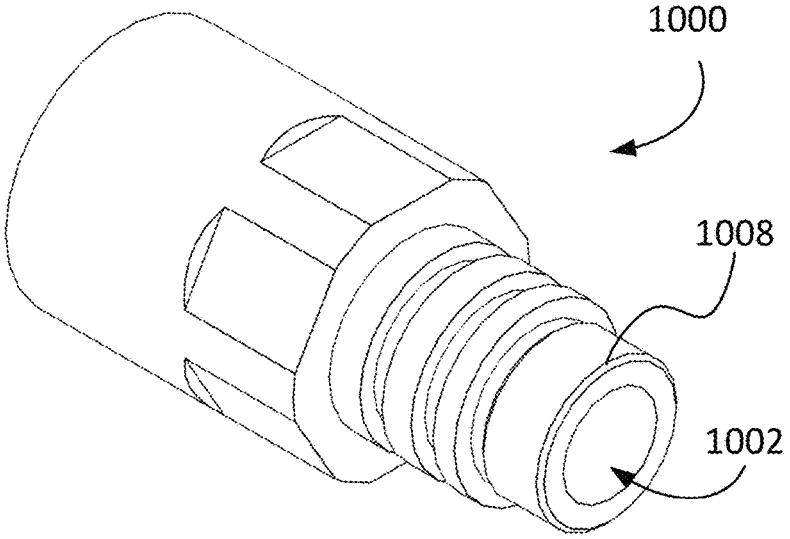
FIG. 10A illustrates an electrical crossover and FIG. 10B illustrates a cross-sectional view of the same, according to one or more embodiments.
Figure 10B:
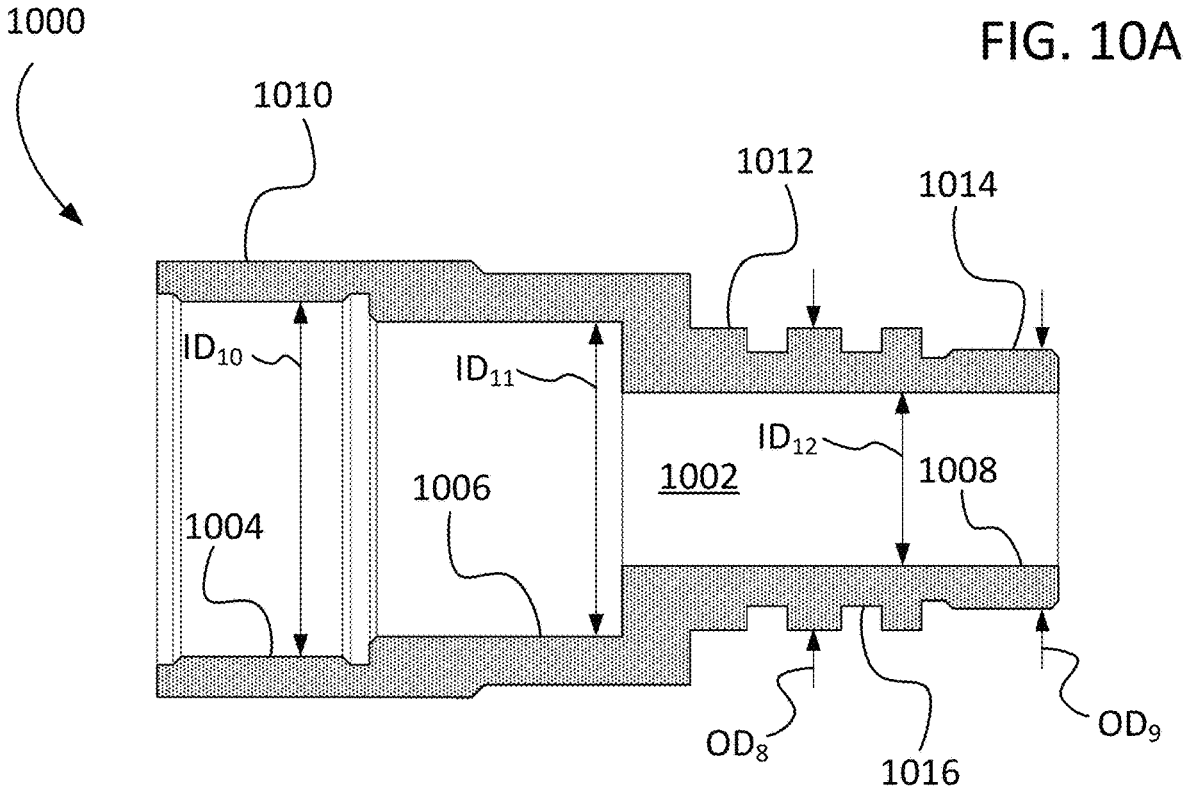

FIG. 10A illustrates an electrical crossover 1000 of the male connector 200 and FIG. 10B illustrates a cross-sectional view of the same, according to one or more embodiments. The electrical crossover 1000 is securable the sealing component 800 and the lock nut 1200, which is employed to secure the electrical pin 1100 to the portion of electrical cable 120 extended through the anchor 400.

The electrical crossover 1000 includes a first crossover internal surface 1004 which is configured to interface with the third seal external surface 810 of the sealing component 800. The third seal external surface 810 has a sixth external diameter $OD_6$ which is matched with the tenth internal diameter $ID_{10}$ of the first crossover internal surface 1004.

The electrical crossover 1000 also includes a second crossover internal surface 1006 which is configured to interface with the fourth seal external surface 812 and the associated O-rings, such that when the stab section 900 is secured to the sealing component 800, the O-rings form a seal between fourth seal external surface 812 and the second crossover internal surface 1006, such that fluids present in the coiled tubing 100 and the male connector 200 are substantially prevented from entering the anchor internal bore 502 between the sealing component 800 and the stab section 900.

The electrical crossover 1000 also includes a third crossover internal surface 1008, having a twelfth inner diameter $ID_{12}$ matched to the gauge of the electrical cable 120, within tolerances. The electrical crossover 1000 also includes a first crossover external surface 1010, which is exposed to the male fluid pathway though the male connector 200. In some examples, the first crossover external surface 1010 or a portion thereof has a standard hexagonal profile, such that standard tools (e.g., a wrench) may be employed to rotate (e.g., screw) the electrical crossover 1000 onto the sealing component 800 (e.g., in embodiments where the first crossover internal surface 1004 and the third seal external surface 810 are compatibly threaded).

The electrical crossover 1000 includes a second crossover external surface 1012, having an eighth external diameter $OD_8$, which is configured to interface with the first female internal surface 1404 of the female tubing crossover 1300 and the female connector internal surface 2004 of the BHA female connector 1900. In some examples, the second crossover external surface 1012 includes O-ring slots 1016, which are circumferentially defined about the second crossover external surface 1012 and configured to house O-ring seals, such that when the stab section 900 is engaged with the female receiver 1500, the O-rings form a seal between second crossover external surface 1012 and the first female internal surface 1404 or the female connector internal surface 2004, such that fluids present in the fluid pathway are substantially prevented from entering the mating area of the stab section 900 and the female receiver 1500. As illustrated, the second crossover external surface 1012 includes two O-ring slots 1016, however other quantities of O-ring slots 1016 are contemplated.

The electrical crossover 1000 includes a third crossover external surface 1014 which is configured to interface with an internal surface 1204 of a lock nut 1200 (see FIGS. 10A and 10B). In some examples, the third crossover external surface 1014 is threaded and the internal surface 1204 of a lock nut 1200 includes compatible threads, such that the lock nut 1200 may be secured to the electrical crossover.

Figure 11A:
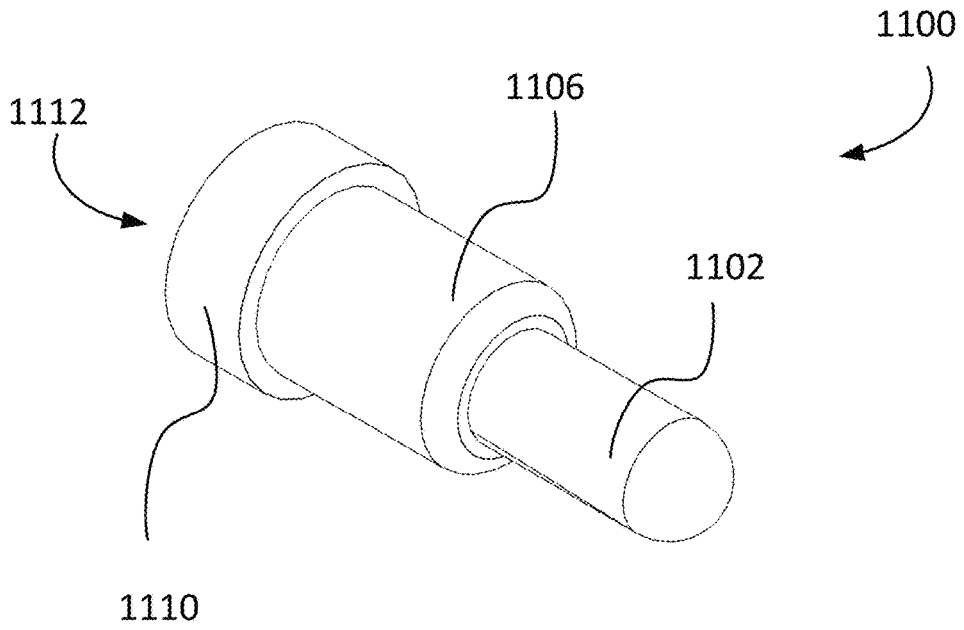
FIG. 11A illustrates an electrical connector and FIG. 11B illustrates a cross-sectional view of the same, according to one or more embodiments.
Figure 11B:
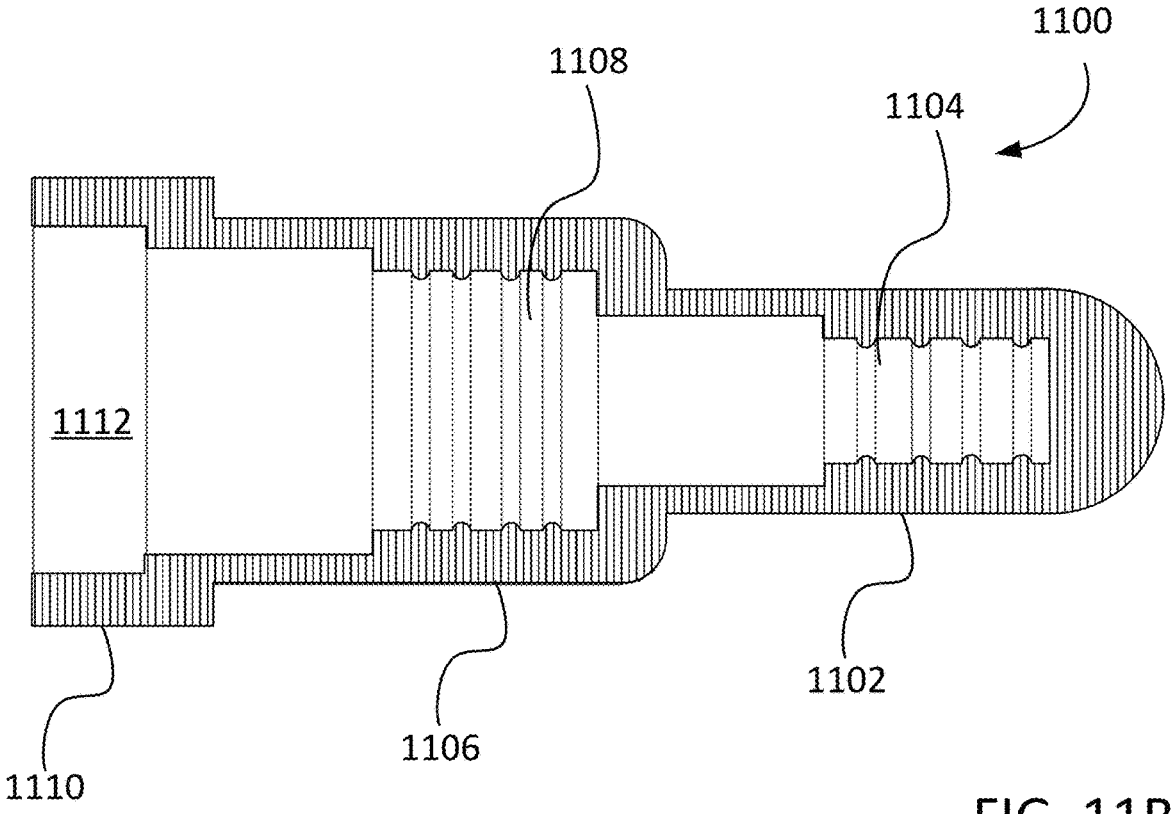

FIG. 11A illustrates an electrical pin 1100 of the stab section 900 and FIG. 11B illustrates a cross-sectional view of the same, according to one or more embodiments. In the illustrated embodiment, the electrical pin 1100 is a tiered pin configured to provide two separate electrical connections for a concentric cable having two distinct and concentric wire paths. The first tier 1102 includes first electrical contacts 1104 configured to interface with the wires of the internal wire path of the electrical cable. The second tier 1106 includes second electrical contacts 1108 configured to interface with the wires of the external wire path of the electrical cable. This disclosure contemplates embodiments where the electrical pin 1100 is configured for use with electrical cables having a single wire path, and concentric cables having more than two distinct concentric wire paths. In some examples, the portion of the electrical cable 120 to which the electrical pin 1100 is secured to is stripped of protective sheathing, such that the wires of the internal wire path and the wires of the external wire paths are electrically connectable to the first electrical contacts 1104 and the second electrical contacts 1108, respectively. The electrical pin 1100 includes an orifice 1112 through which an exposed end of the electrical cable may be inserted. The electrical pin 1100 may further include a pin flange 1110, where a first side of the pin flange 1110 abuts the electrical crossover, and second side of the pin flange 1110 is gripped by the lock nut 1200 to secure the electrical pin 1100 to the electrical crossover 1000.

According to one or more embodiments, the electrical pin 1100 is constructed of both conductive and insulative materials, where the first electrical contacts 1104 and second electrical contacts 1108 are constructed of conductive materials, and insulative materials are disposed between the first tier 1102 and the second tier 1106 to isolate the electrical flows from each respective wire path. According to one or more embodiments, the electrical pin 1100, or portions thereof, may be crimped to improve connection between the electrical pin 1100 and the electrical cable 120.

Figure 12A:
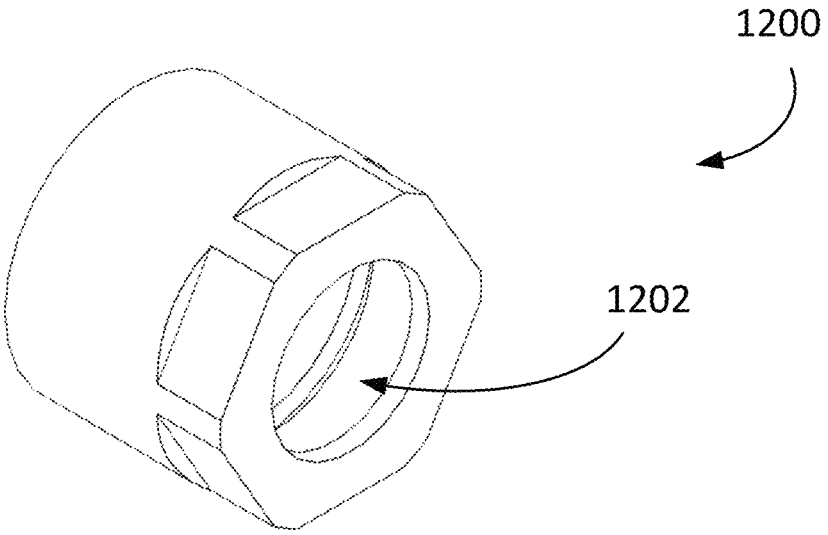
FIG. 12A illustrates a lock nut and FIG. 12B illustrates a cross-sectional view of the same, according to one or more embodiments.
Figure 12B:
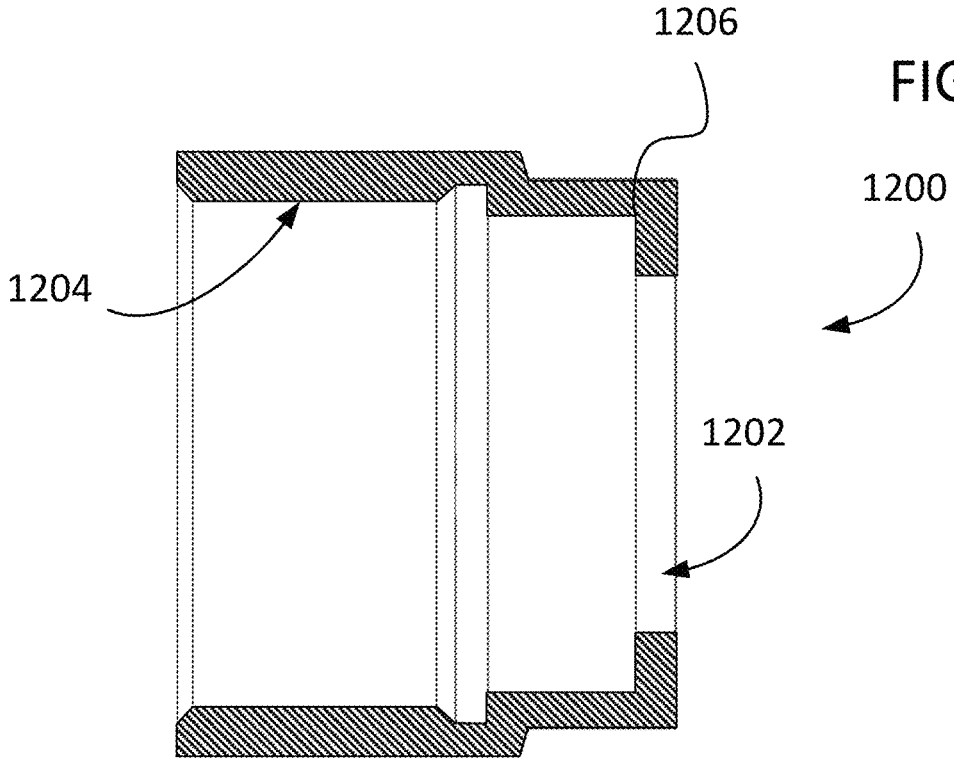

FIG. 12A illustrates a lock nut 1200 of the stab section 900 and FIG. 12B illustrates a cross-sectional view of the same, according to one or more embodiments. The lock nut 1200 includes an orifice 1202 bounded by a lock nut flange 1206, where the orifice 1202 is configured to be installed over the first tier 1102 and the second tier 1106 of the electrical pin 1100, such that the lock nut flange 1206 abuts the second side of the pin flange 1110. The lock nut 1200 includes an internal surface 1204, which may be configured to interface with the third crossover external surface 1014 of the electrical crossover 1000 via a compatible threaded connection.

Figure 13:
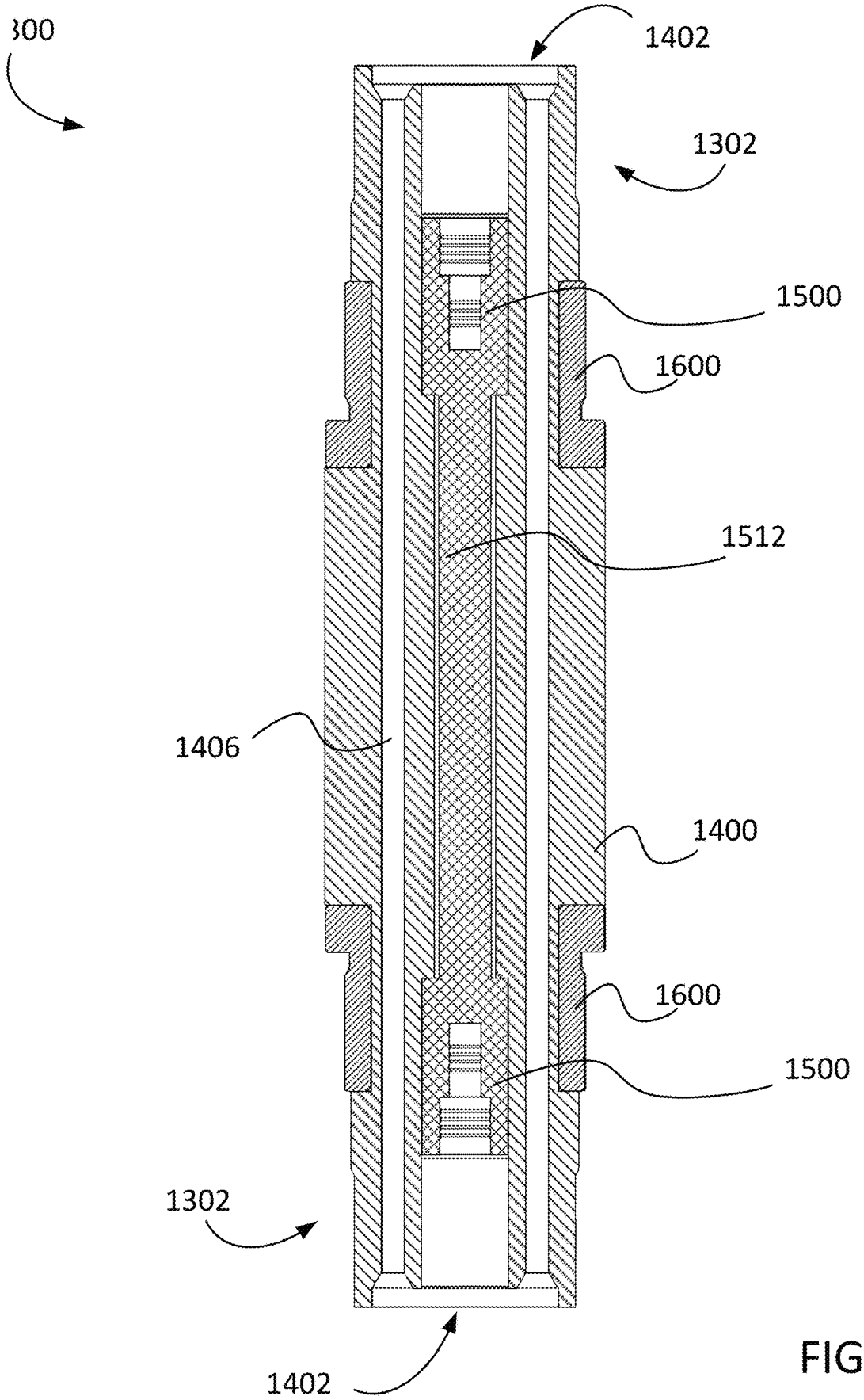
FIG. 13 illustrates a cross-sectional view of a female tubing crossover, according to one or more embodiments.

FIG. 13 illustrates a cross-sectional view of a female tubing crossover 1300, which includes a female crossover housing 1400, two female connectors 1302 and two fastening rings 1600, according to one or more embodiments. The female tubing crossover 1300 is connectable with two respective male connectors 200 and is thus operable to connect two sections of coiled tubing 100 (e.g., provide a fluid pathway and an electrical connection therebetween), where each section of coiled tubing 100 includes a male connector 200.

Figure 14A:
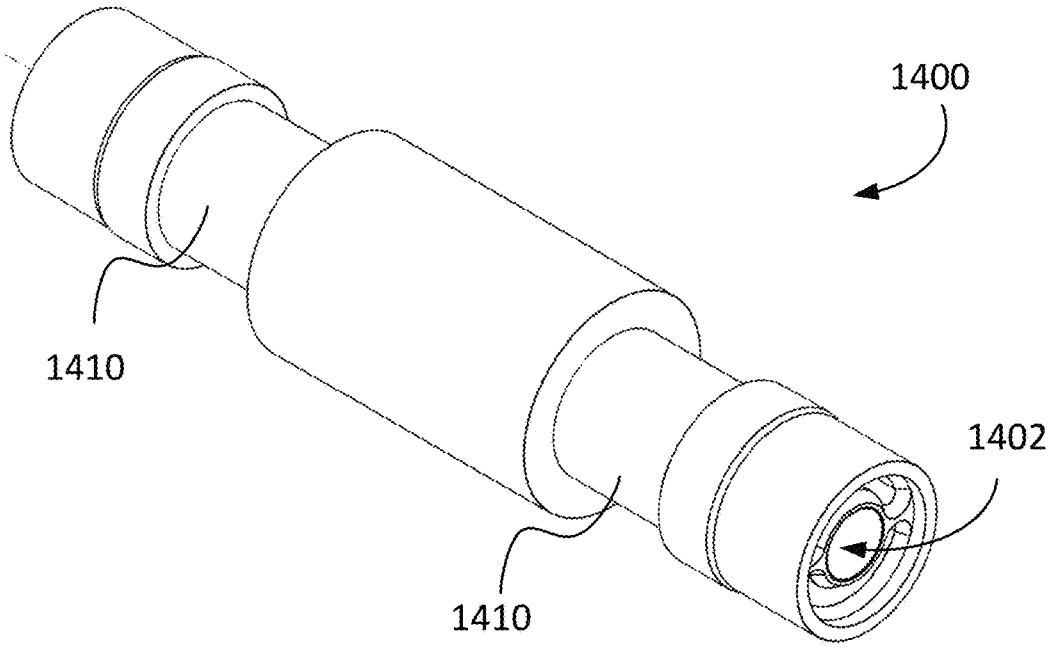
FIG. 14A illustrates female crossover housing and FIG. 14B illustrates a cross-sectional view of the same, according to one or more embodiments.
Figure 14B:
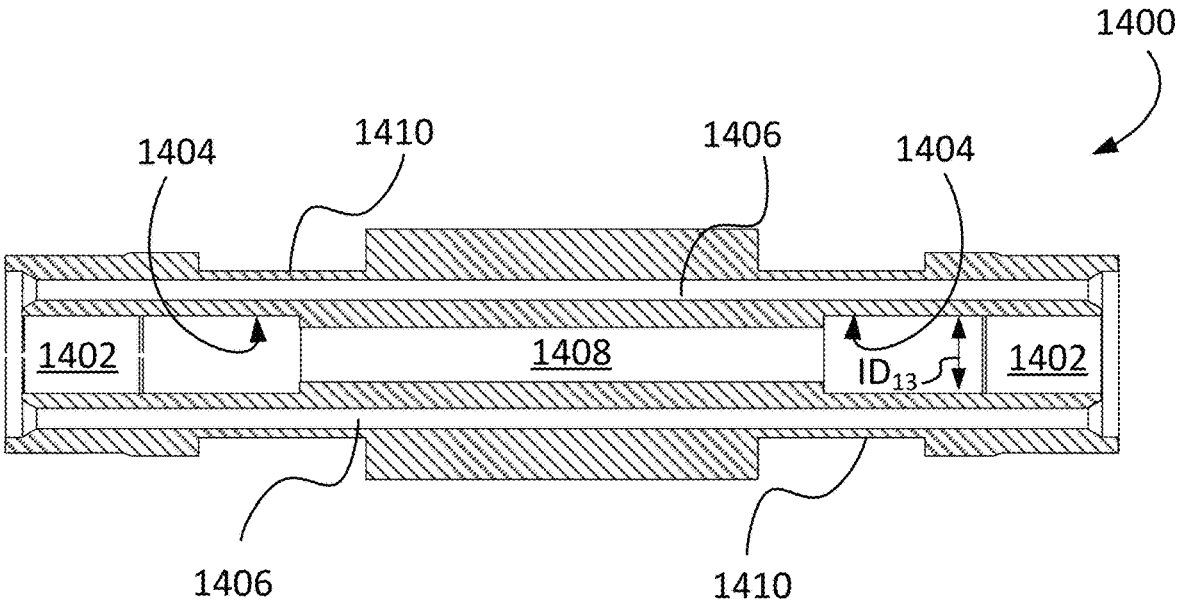

FIG. 14A illustrates a female crossover housing 1400 and FIG. 14B illustrates a cross-sectional view of the same, according to one or more embodiments. The female crossover housing 1400 include crossover orifices 1402, which are configured to house female receivers 1500. The crossover orifices 1402 further include first female internal surfaces 1404 having a thirteenth inner diameter $ID_{13}$, which is matched with the eighth external diameter $OD_8$ of the second crossover external surface 1012 of the electrical crossover 1000. When the stab section 900 is inserted into the crossover orifice 1402 (e.g., to be connected to the female receiver 1500), the second crossover external surface 1012 interfaces with the first female internal surface 1404 and forms a seal in conjunction with the O-rings disposed in the O-ring slots 1016. Forming the seal substantially prevents fluids present in the fluid pathway from entering the mating area of the stab section 900 and the female receiver 1500 when the male connector 200 and the female tubing crossover 1300 are engaged.

The female crossover housing 1400 further includes fluid channels 1406 configured to provide a female fluid pathway through the female crossover housing 1400. When the female tubing crossover 1300 is connected with sections of coiled tubing 100, the fluid channels 1406 are aligned with the fluid pathways defined in the male connectors 200 and are fluidly connected thereto.

The female crossover housing 1400 also defines an electrical channel 1408, which houses the electrical throughput 1512 (see FIG. 13) which connects the two female receivers 1500. The female crossover housing 1400 further includes ring channels 1410, which are configured to accommodate the fastening rings 1600 (see FIGS. 16A and 16B).

Figure 15A:
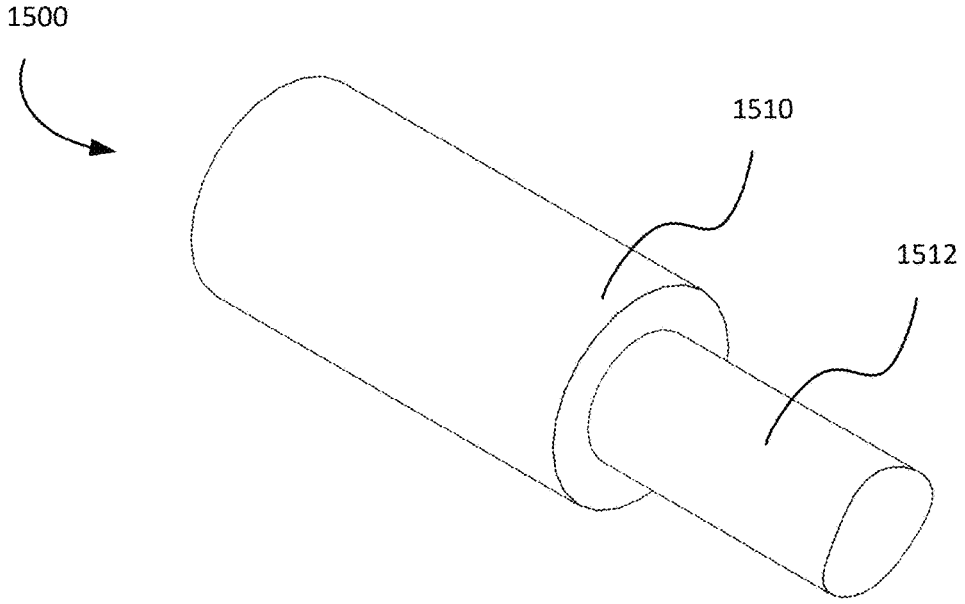
FIG. 15A illustrates a wet-mate female connector and FIG. 15B illustrates a cross-sectional view of the same, according to one or more embodiments.
Figure 15B:
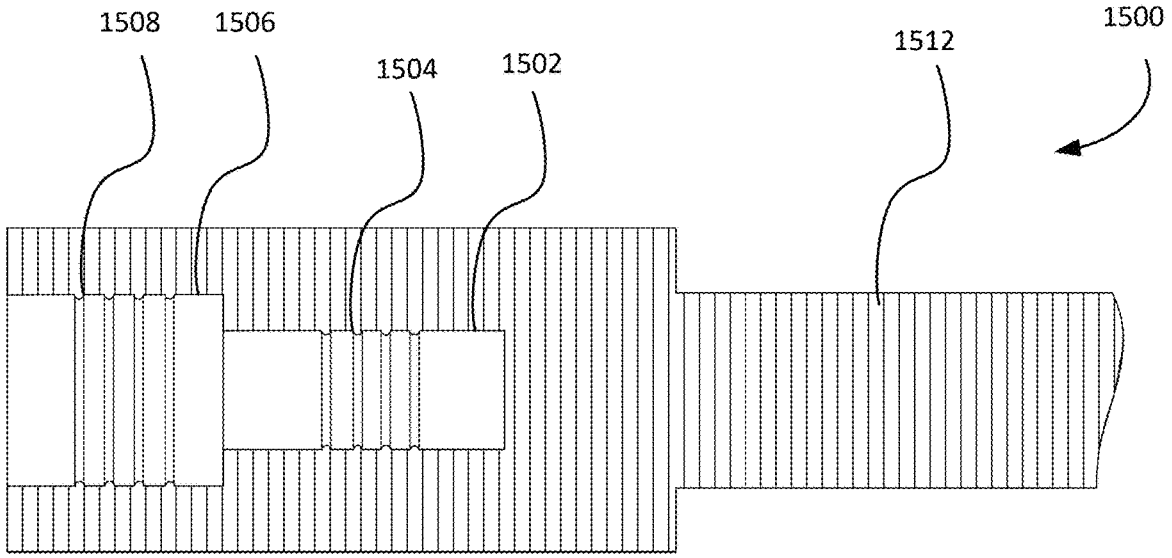

FIG. 15A illustrates a female receiver 1500 and FIG. 15B illustrates a cross-sectional view of the same, according to one or more embodiments. The female receiver 1500 is configured to interface with the stab section 900 of a male connector 200 and includes inversely tiered surfaces matched with the tiered surfaces of the electrical pin 1100. As an example, each female receiver 1500 includes a first tier 1502 having first electrical contacts 1504 configured to interface with the first electrical contacts 1104 of the first tier 1102 of the electrical pin 1100, and a second tier 1506 having second electrical contacts 1508 configured to interface with the second electrical contacts 1108 of the electrical pin 1100.

The female receiver 1500 of the female connector 1302 is electrically connected with the electrical throughput 1512. When the female receiver 1500 is disposed in the female tubing crossover 1300, the electrical throughput 1512 extends through and provides an electrical connection from a first female receiver 1500 on a first side of the female tubing crossover 1300 to a second female receiver 1500 on a second side of the female tubing crossover 1300 (see FIG. 13). According to one or more embodiments, the electrical throughput 1512 may include one or more electrical rails, one or more electrical wires, one or more electrical cables, or other conventional structures capable of sustaining electrical connections.

Figure 16A:
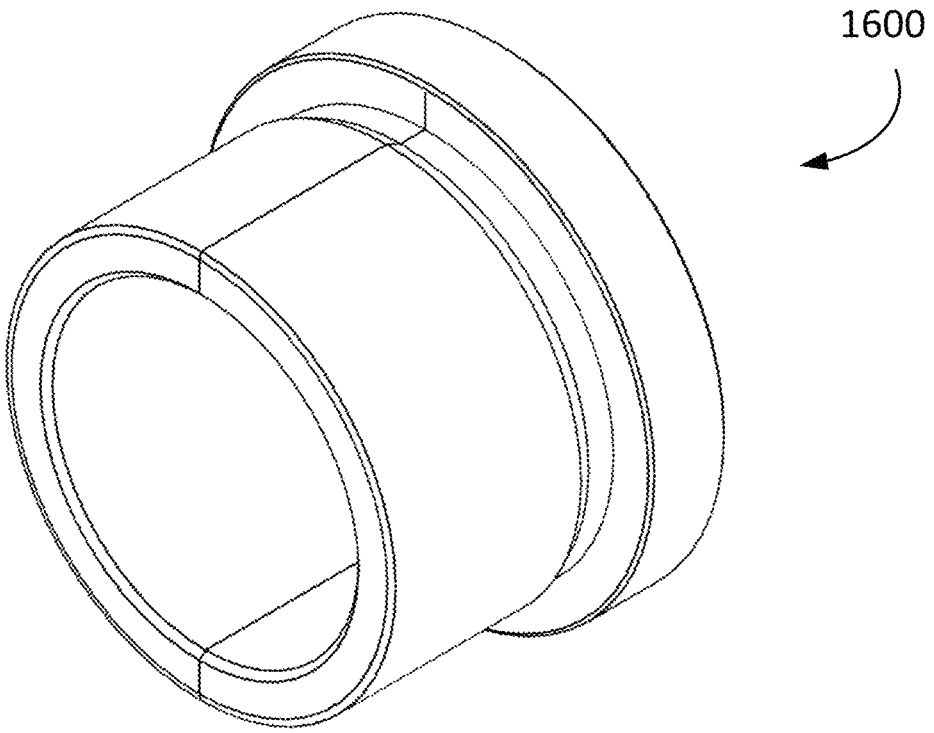
FIG. 16A illustrates a fastening ring and FIG. 16B illustrates a cross-sectional view of the same, according to one or more embodiments.
Figure 16B:
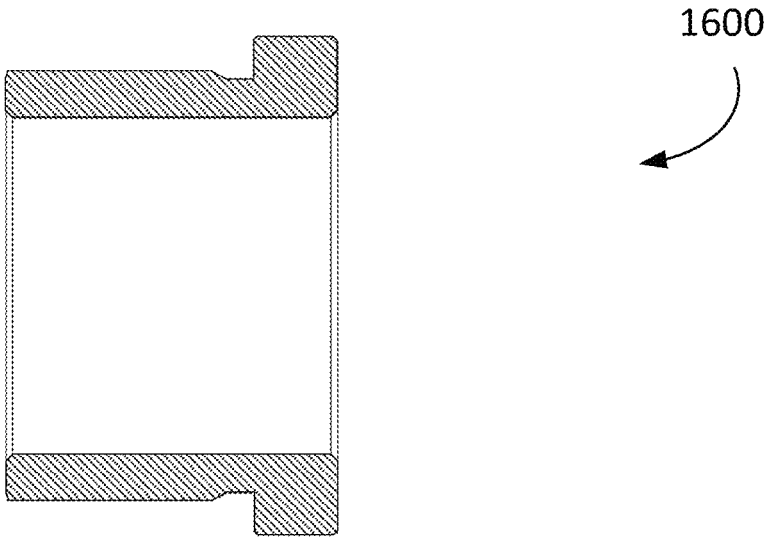

FIG. 16A illustrates a fastening ring 1600, and FIG. 16B illustrates a cross-sectional view of the same. The fastening ring 1600 may be configured to be disposed in the ring channels 1410 the female crossover housing 1400 (e.g., or the female connector housing 2000) and provide a means of securing the section of coiled tubing 100 to the female tubing crossover 1300 (e.g., or the BHA). According to one or more embodiments, the fastening ring 1600 is a split ring, which may be used to provide a compression fit between the female tubing crossover 1300 (e.g., or the BHA female connector 1900) and the male connector 200. In other examples, the fastening ring 1600 is threaded and matched with threads on the third housing internal surface 316 of the male housing 300.

Figure 17:
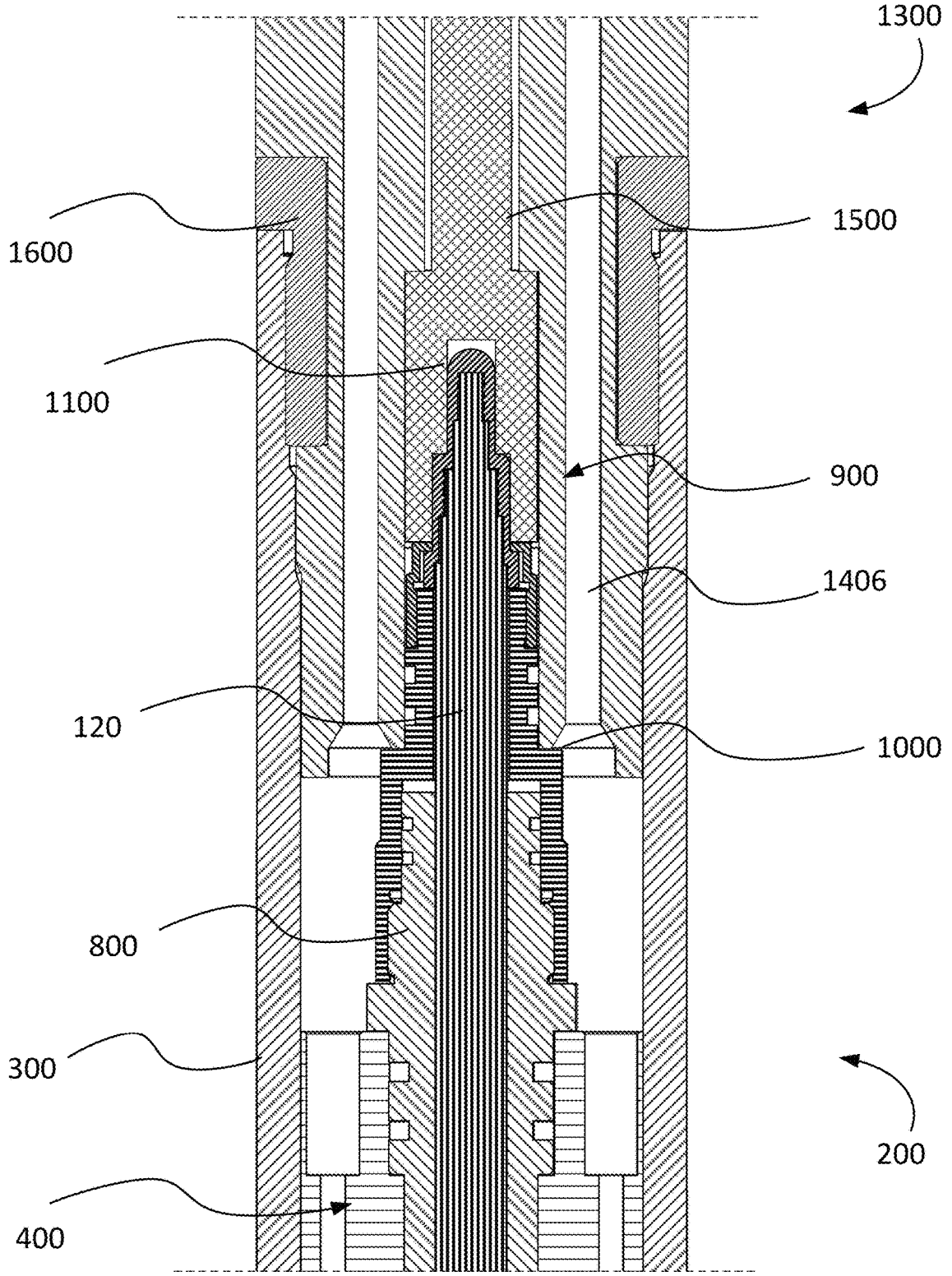
FIG. 17 illustrates a detailed cross-sectional view of a male connector interfacing with a female crossover, according to one or more embodiments.

FIG. 17 illustrates a detailed cross-sectional view of a male connector 200 interfacing with a female tubing crossover 1300 (or a BHA female connector 1900 shown in FIG. 19), according to one or more embodiments. The first female internal surface 1404 of the crossover orifice 1402 of the female crossover housing 1400 interface with the electrical crossover 1000 of the male connector 200, and the O-ring slots 1016 containing O-rings may form a seal with the first female internal surface 1404 of the crossover orifice 1402 preventing fluid in the male fluid pathway or the female fluid pathway from entering the mating area of the stab connection, facilitating the electrical connection between the male connector 200 of the section of coiled tubing 100 and the female tubing crossover 1300. The fastening rings 1600 interface with the male housing 300 and female crossover housing 1400, providing a secure connection therebetween, so as not to rely on the physical strength of the electrical connections (e.g. the male connector 200 and the female connector 1500) alone when the fittings are exposed to stresses during use.

Figure 18:
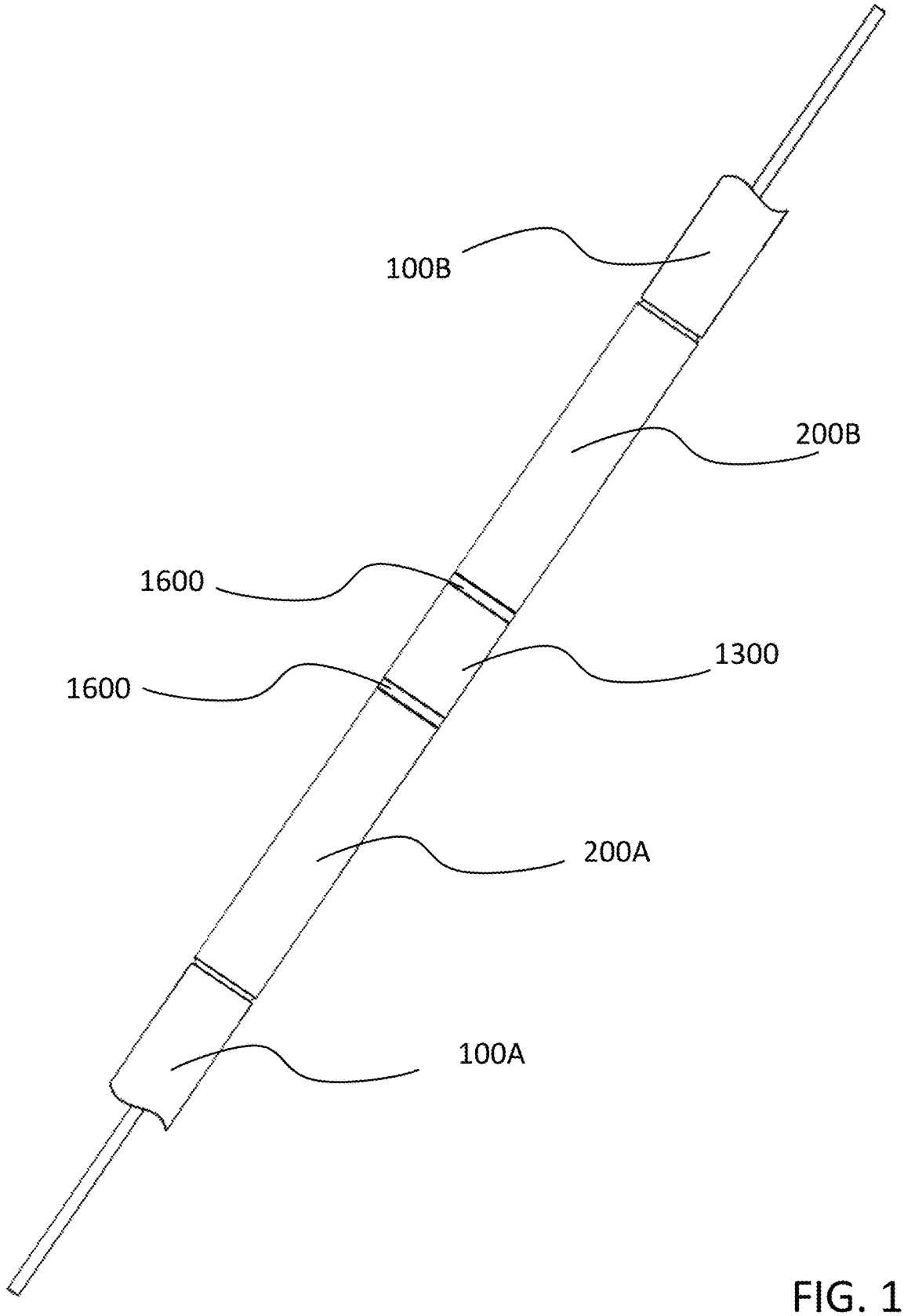
FIG. 18 illustrates a first portion of coiled tubing connected to a second portion of coiled tubing via male connectors and a female tubing crossover, according to one or more embodiments.

FIG. 18 illustrates a first coiled tubing section 100A connected to a second coiled tubing section 100B via a first male connector 200A (e.g., affixed to the first coiled tubing section 100A) interfacing with a female tubing crossover 1300, the female tubing crossover 1300 further interfacing with a second male connector 200B (e.g., affixed to the second coiled tubing section 100B), according to one or more embodiments. The male connectors 200A, B may be inserted into the female tubing crossover 1300 such that the male connectors 200A, B are received into the female connectors 1302 and a seal is formed between the first female internal surfaces 1404 of the crossover orifices 1402 of the female crossover housing 1400 and the second crossover external surfaces 1012 of the electrical crossovers 1000. The fastening rings 1600 may be engaged such that the male housings 300 are securely fastened to the female crossover housing 1400. The fluid channels 1406 of the female tubing crossover 1300 provide fluid communication with the male fluid pathway defined in the first male connector 200A to the female fluid pathway defined in the female tubing crossover 1300 to the male fluid pathway of second male connector 200B and vice versa. In one or more embodiments, a continuous system fluid pathway is formed from the tube internal bore 102 of the first coiled tubing section 100A, to the male connector 200, to the fluid channels 1406 of the female tubing crossover 1300, to the second male connector 200B, to the tube internal bore 102 of the second coiled tubing section 100B. In one or more embodiments, a continuous system electrical connection is provided from the electrical cable 120 in the first coiled tubing section 100A, to the stab section 900 of the first male connector 200A, to the female receivers 1500 of the female connectors 1302 of the female tubing crossover 1300, to the stab section 900 of the second male connector 200B, to the electrical cable 120 in the second coiled tubing section 100B. In one or more embodiments, the continuous system electrical connection is physically isolated from the continuous system fluid pathway defined between the first coiled tubing section 100A and the second coiled tubing section 100B.

FIG. 19 illustrates a partially cross-sectioned view of a BHA female connector 1900 that is attached to a BHA 1950, including a female connector housing 2000, a female receiver 1500, and a fastening ring 1600, according to one or more embodiments. Like the female tubing crossover 1300, the BHA female connector 1900 is connectable with a male connector 200 and interfaces with the male connector 200 as illustrated in FIG. 17. As such, the BHA female connector 1900 includes many similar features and shares same components with the female connector 1302 of the female tubing crossover 1300 (e.g., fastening rings 1600, and female receiver 1500). Furthermore, the BHA female connector 1900 is affixable to the BHA 1950 or other compatible devices, and is operable to provide fluid communication and an electrical connection between the male connector 200 (e.g., and thus the coiled tubing 100) and the BHA 1950. When the female connector 1500 is disposed in a BHA female connector 1900, the electrical throughput 1512 extends and provides an electrical connection from the female connector 1500 to the electrical system of the BHA 1950 (See FIGS. 19-25). The BHA female connector 1900 includes a female receiver 1500, which is connectable with the stab section 900 to form an electrical connection that is isolated from fluid flow within the male connector 200 and the BHA female connector 1900. The female connector housing 2000 further includes an indented ridge 2010, which is configured to accommodate the fastening ring 1600. The fastening ring 1600 interfaces with the male housing 300 and the female connector housing 2000, providing a secure connection therebetween, so as not to rely on the physical strength of the electrical connections (e.g. the stab section 900 and the female receiver 1500) when the fittings are exposed to stresses during use.

Figure 20A:
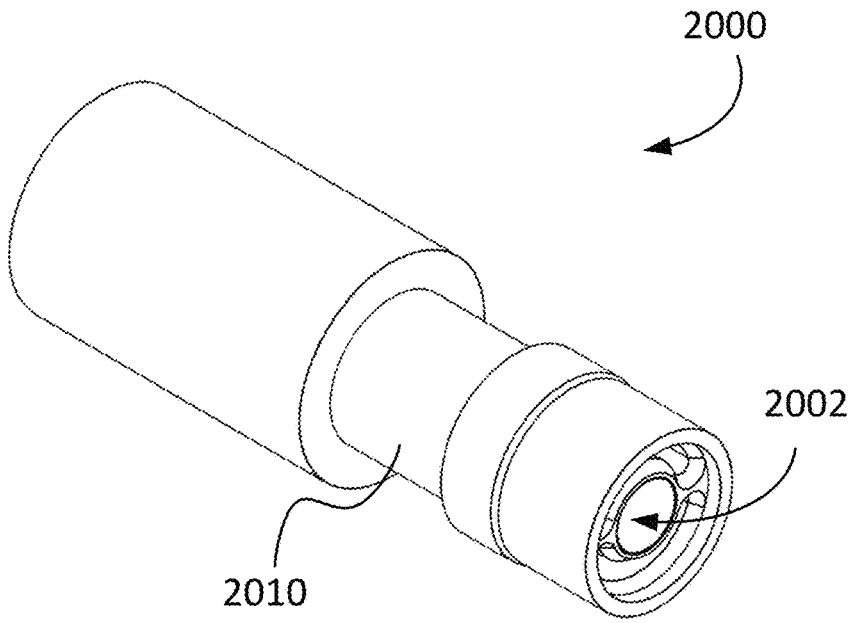
FIG. 20A illustrates a female BHA housing and FIG. 20B illustrates a cross-sectional view of the same, according to one or more embodiments.
Figure 20B:
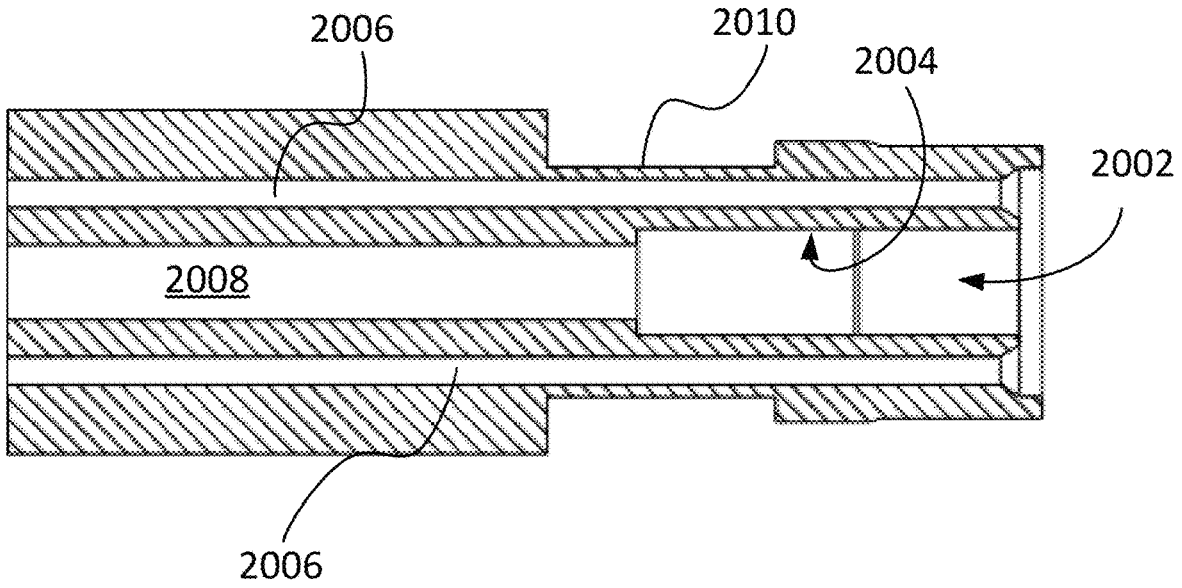

FIG. 20A illustrates the female connector housing 2000 and FIG. 20B illustrates a cross-sectional view of the same, according to one or more embodiments. The female connector housing 2000 includes a connector orifice 2002 which may be structurally similar to the crossover orifices 1402 of the female crossover housing 1400, and thus also includes a female connector internal surface 2004 which is structurally similar to the first female internal surface 1404 of the female crossover housing 1400 and is configured to receive the male connector 200. The first female internal surface 1404 of the crossover orifice 1402 of the female connector housing 2000 interfaces with the electrical crossover 1000 of the male connector 200, and the O-ring slots 1016 containing O-rings may form a seal with the female connector internal surface 2004 of the connector orifice 2002 preventing fluid in the male fluid pathway or the female fluid pathway from entering the mating area of the stab section 900 and the female receiver 1500, facilitating the electrical connection between the male connector 200 and the BHA female connector 1900.

The female connector housing 2000 further defines fluid channels 2006, configured to provide a fluid pathway through the female connector housing 2000 to the BHA 1950. When the BHA female connector 1900 is connected with the male connector 200, the fluid channels 2006 define a female fluid pathway and are aligned with the male fluid pathway defined in the male connector 200 and are fluidly connected thereto. The female connector housing 2000 also defines an electrical connector channel 2008, which houses the electrical throughput 1512 which connects one female receiver 1500 to an electrical system of the BHA 1950.

Figure 21:
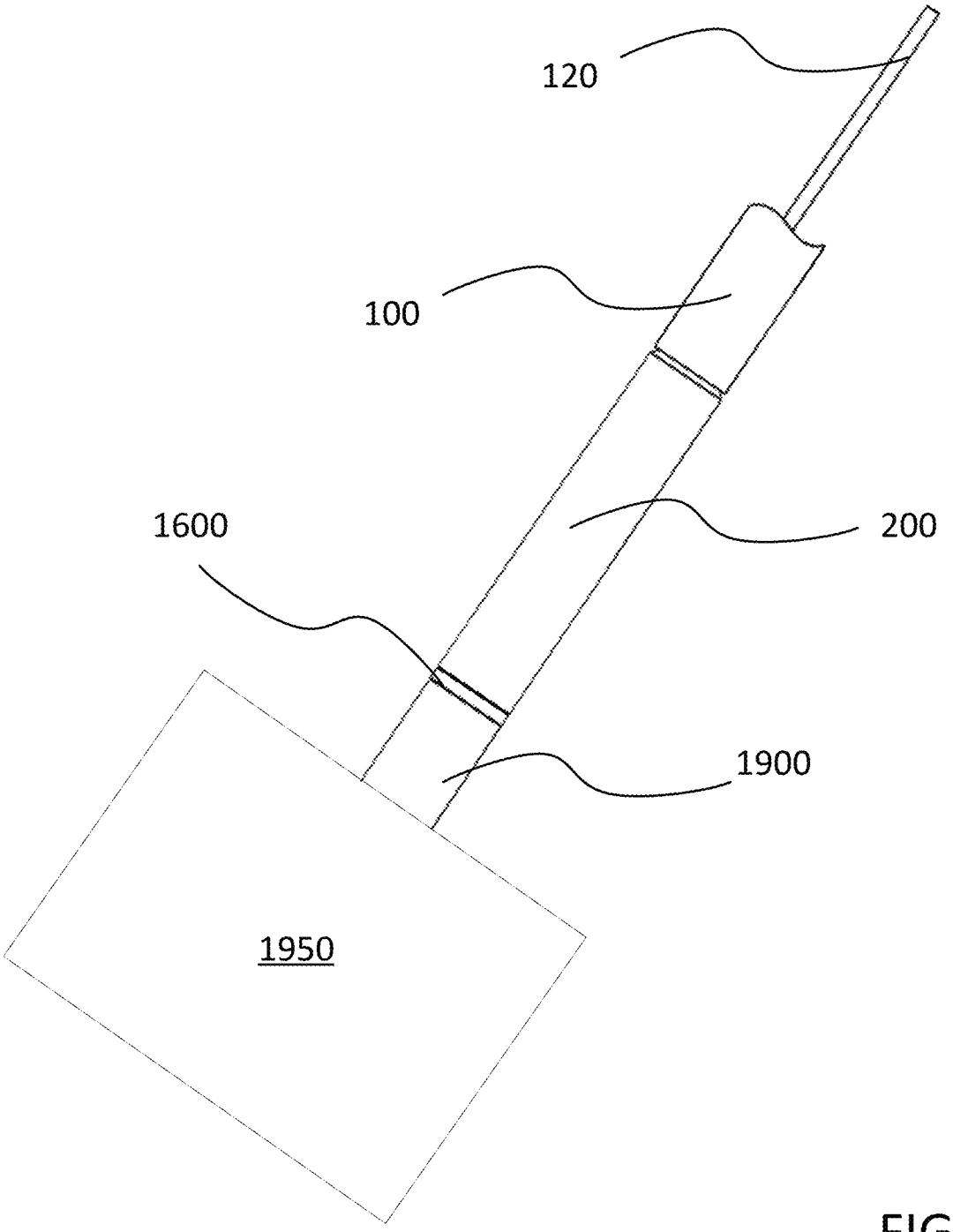
FIG. 21 illustrates a section of coiled tubing connected to a BHA having a BHA female connector via a male connector, according to one or more embodiments.

FIG. 21 illustrates a portion of coiled tubing 100 connected to a BHA 1950 via a connection system including a male connector 200 interfacing with a BHA female connector 1900 affixed to the BHA 1950. The BHA 1950 may include, for example, a rotary steerable system ("RSS"), logging while drilling (LWD) and measurement-while-drilling (MWD) tools, dummy collars, and a drill bit. One skilled in the art should also understand that the BHA 1950 may have other configurations as well. The connection system delivers electrical power and/or control signals to the BHA 1950 through the electrical cable 120 and delivers a fluid flow from, or removes a fluid flow to, the coiled tubing 100 via the fluid pathways defined in the male connector 200 and the BHA female connector 1900.

Figure 22:
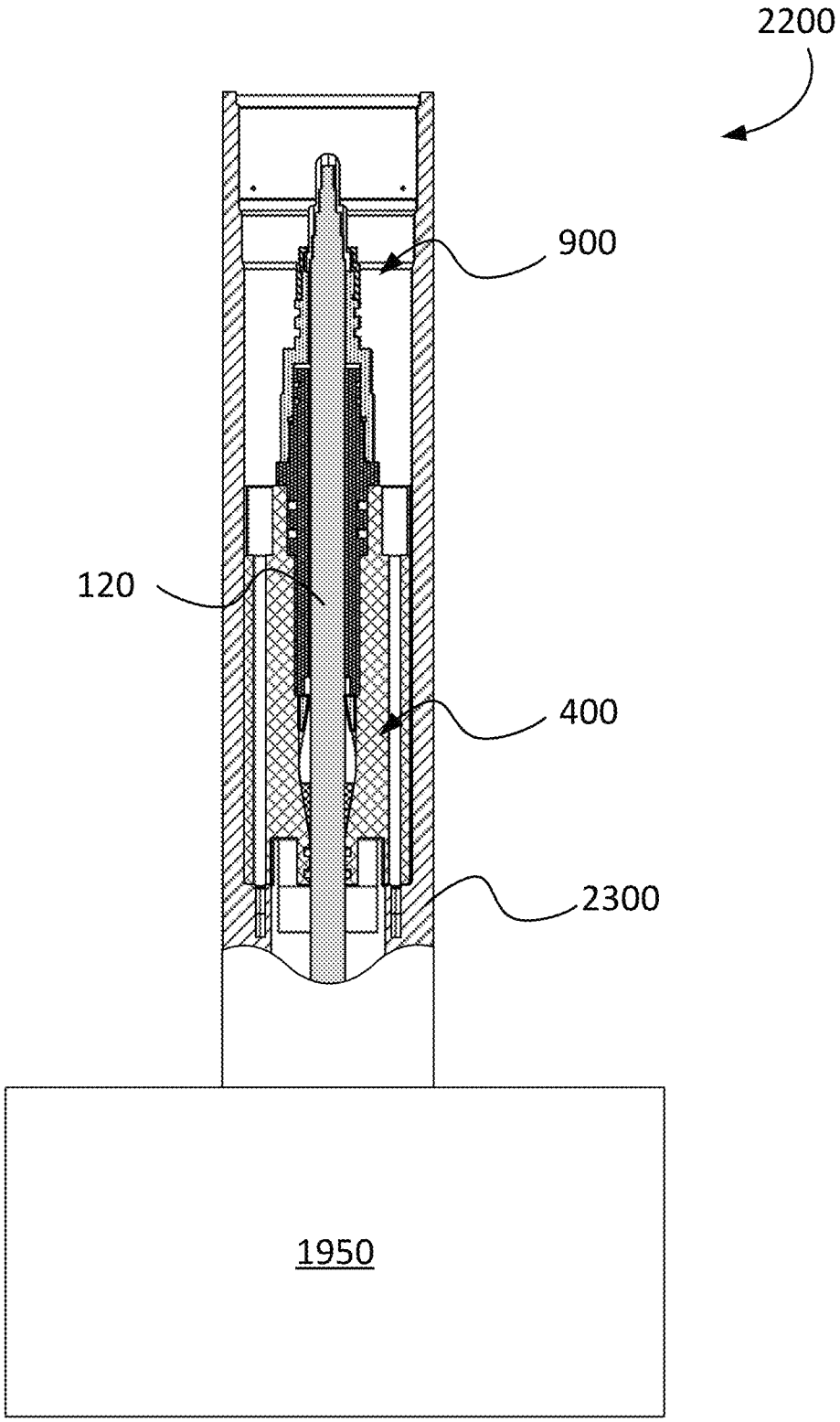
FIG. 22 illustrates a cross-sectional view of a male BHA tubing connector, according to one or more embodiments.

FIG. 22 illustrates a partially cross-sectioned view of a BHA connector that is a BHA male connector 2200 attached to a BHA 1950, including a male housing 2300, a stab section 900, and an anchor 400, according to one or more embodiments. Like the male connector 200, the BHA male connector 2200 is connectable with the female tubing crossover 1300 and interfaces with the female tubing crossover 1300 as illustrated in FIG. 17. As such, the BHA male connector 2200 includes many similar features and shares same components with the male connector 200 (e.g., anchor 400, and stab section 900). Furthermore, the male BHA tubing connector is affixable to the BHA 1950 and is operable to provide fluid communication and an electrical connection between the BHA 1905, the female tubing crossover 1300, and also a section of coiled tubing 100 connected with the other side of the female tubing crossover 1300. The BHA male connector 2200 includes a stab section 900, which is connectable with the female receiver 1500 to form an electrical connection that is isolated from fluid flow within the BHA male connector 2200 and the female tubing crossover 1300.

In some examples, the anchor 400, and stab section 900 in the BHA male connector 2200 may be modified to have a unified construction, such that the first electrical contacts 1104 and second electrical contacts 1108 are hard-wired into the electrical system of the BHA, and the anchor 400 is a fixed or integrated with the male housing 2300, and/or the male connector is fixed to or integrated with the anchor 400. In such embodiments, as the electrical connections are hard wired directly to the electrical system, and the stab section 900 is fixed to the anchor 400 and the anchor 400 may not include a collet 600, collet cone 700, or a sealing component 800.

Figure 23A:
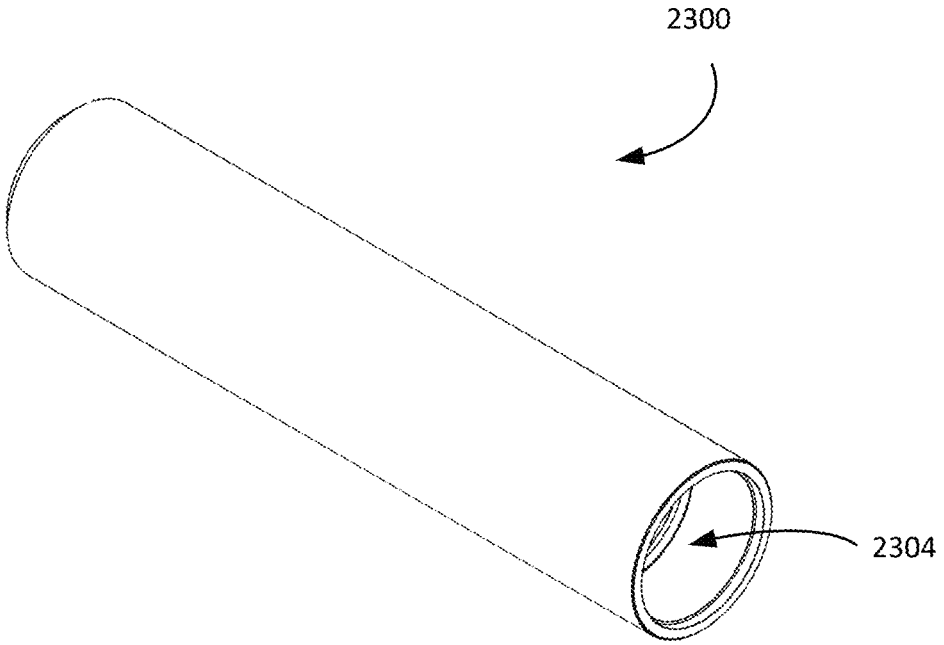
FIG. 23A illustrates a male BHA housing and FIG. 23B illustrates a cross-sectional view of the same, according to one or more embodiments.
Figure 23B:
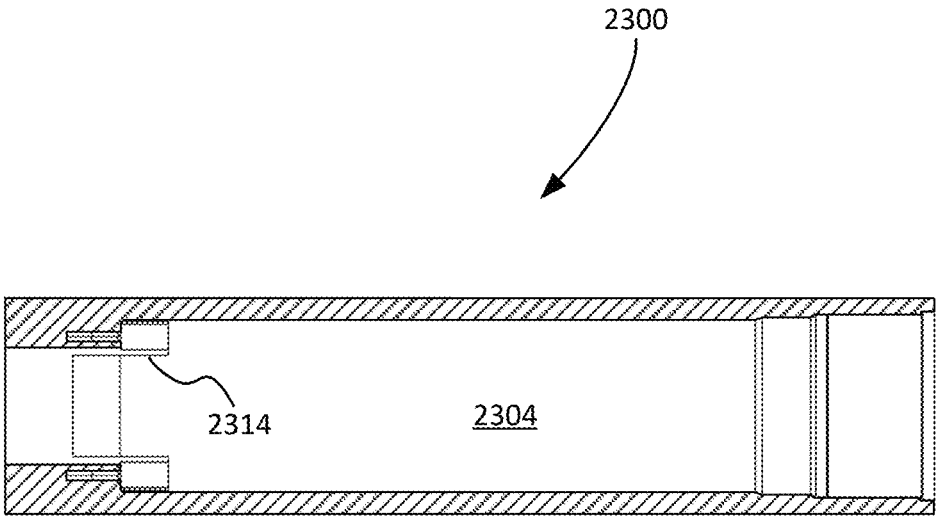

FIG. 23A illustrates a BHA male housing 2300 and FIG. 23B illustrates a cross sectional view of the same, according to one or more embodiments. The male housing 2300 is similar to the male housing 300, with the exception that the male housing 2300 does not include a tubing end 320, or the accompanying features. The BHA male housing 2300 is affixable to or may be integrated with the BHA 1950.

In some examples, the male housing 2300 includes a connector housing internal bore 2304 which defines a male fluid pathway through the male housing 2300. The connector housing internal bore 2304 may include a connector housing flange 2314, which is structurally similar or identical to the housing flange 314 of the male housing 300 of the male connector 200, and interfaces with the anchor 400 in the same manner as the male housing 300. Furthermore, the BHA male housing 2300 interfaces with the female tubing crossover 1300 in the same manner, and with analogous components as does the male housing 300.

Figure 24:
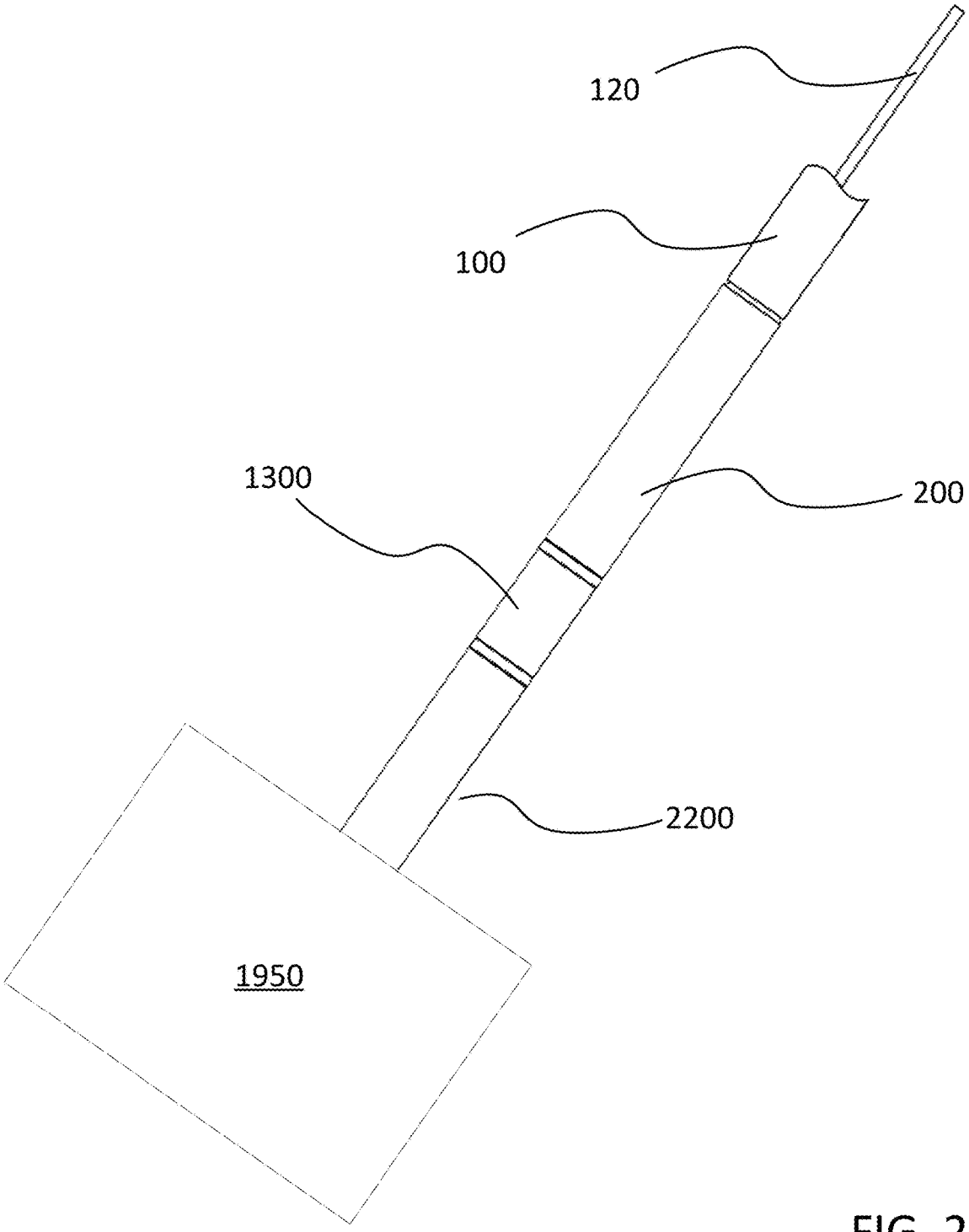
FIG. 24 illustrates a section of coiled tubing connected to a BHA having a male BHA tubing connector via a male connector, and a female tubing crossover, according to one or more embodiments.

FIG. 24 illustrates a portion of coiled tubing 100 connected to a BHA 1950 via a connection system including a male connector 200 interfacing with a female tubing crossover 1300, which is connected to a BHA male connector 2200 affixed to the BHA 1950. The BHA 1950 may include, for example, a rotary steerable system ("RSS"), logging while drilling (LWD) and measurement-while-drilling (MWD) tools, dummy collars, and a drill bit. One skilled in the art should also understand that the BHA 1950 may have other configurations as well. The connection system delivers electrical power and/or control signals to the BHA 1950 through the electrical cable 120 and also delivers a fluid flow from, or removes a fluid flow to, the coiled tubing 100 via the fluid pathways defined in the male connector 200, the female tubing crossover 1300 and the BHA male connector 2200.

Figure 25:
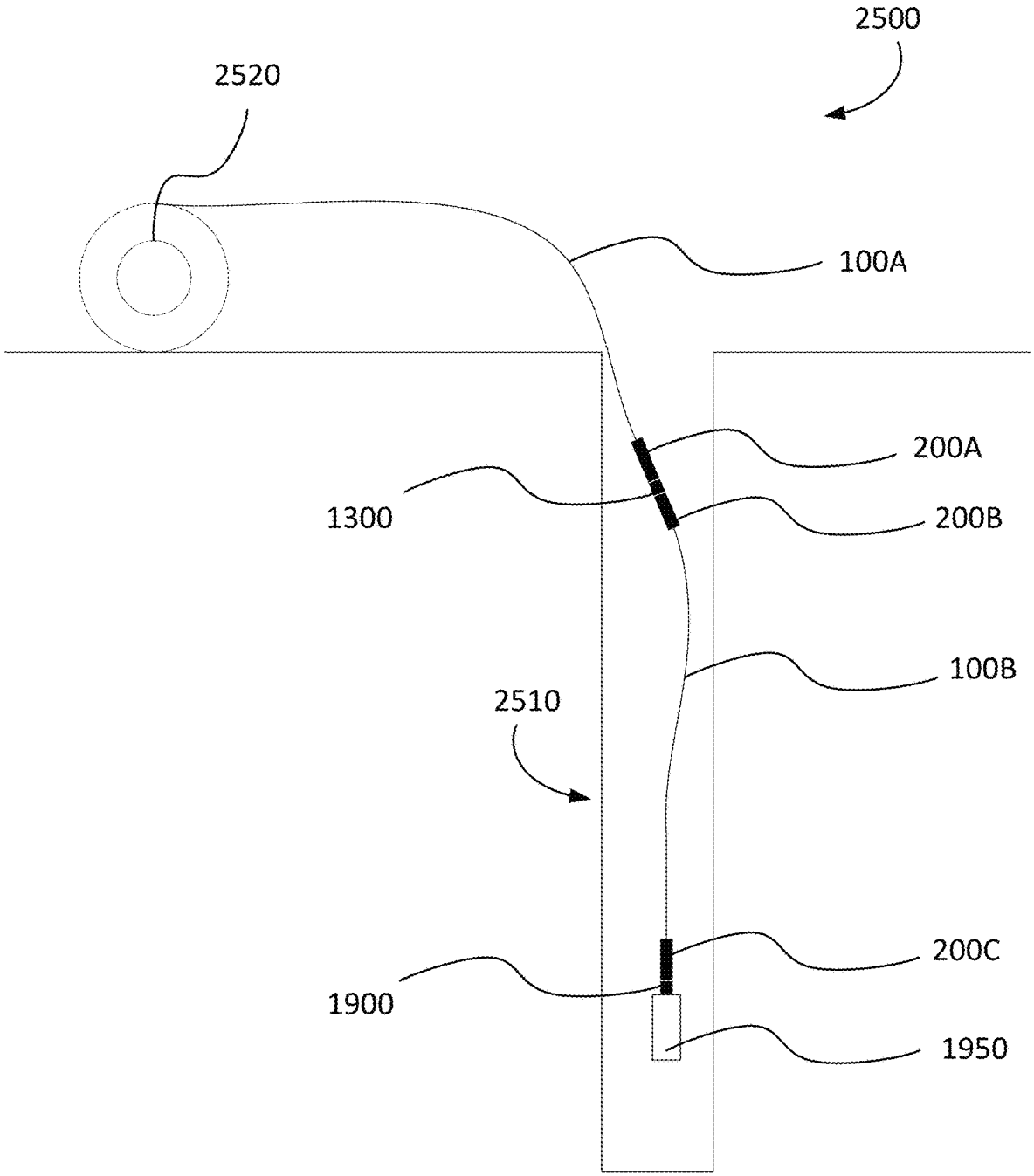
FIG. 25 illustrates an example drilling system, according to one or more embodiments.

FIG. 25 illustrates an example system 2500 at least partially locatable in a well 2510, including a coiled tubing reel 2520 of sections of coiled tubing 100, a first coiled tubing section 100A having a first male connector 200A, a second coiled tubing section 100B having a second male connector 200B and a third male connector 200C, a female tubing crossover 1300, and a BHA 1950 having a BHA female connector 1900. The first male connector 200A and the second male connector 200B are connected with the female tubing crossover 1300, thus facilitating fluid communication and electrical connection between the first coiled tubing section 100A and the second coiled tubing section 100B. The third male connector 200C is mated to the BHA female connector 1900 of the BHA 1950, thus facilitating fluid communication and electrical connection between the first coiled tubing section 100A, the second coiled tubing section 100B, and the BHA 1950. The example system 2500 is illustrative of how the connection system may be employed to provide fluid and electrical communication to the BHA 1950 disposed in a well 2510 from a surface apparatus (e.g. coiled tubing reel 2520).

Figure 26:
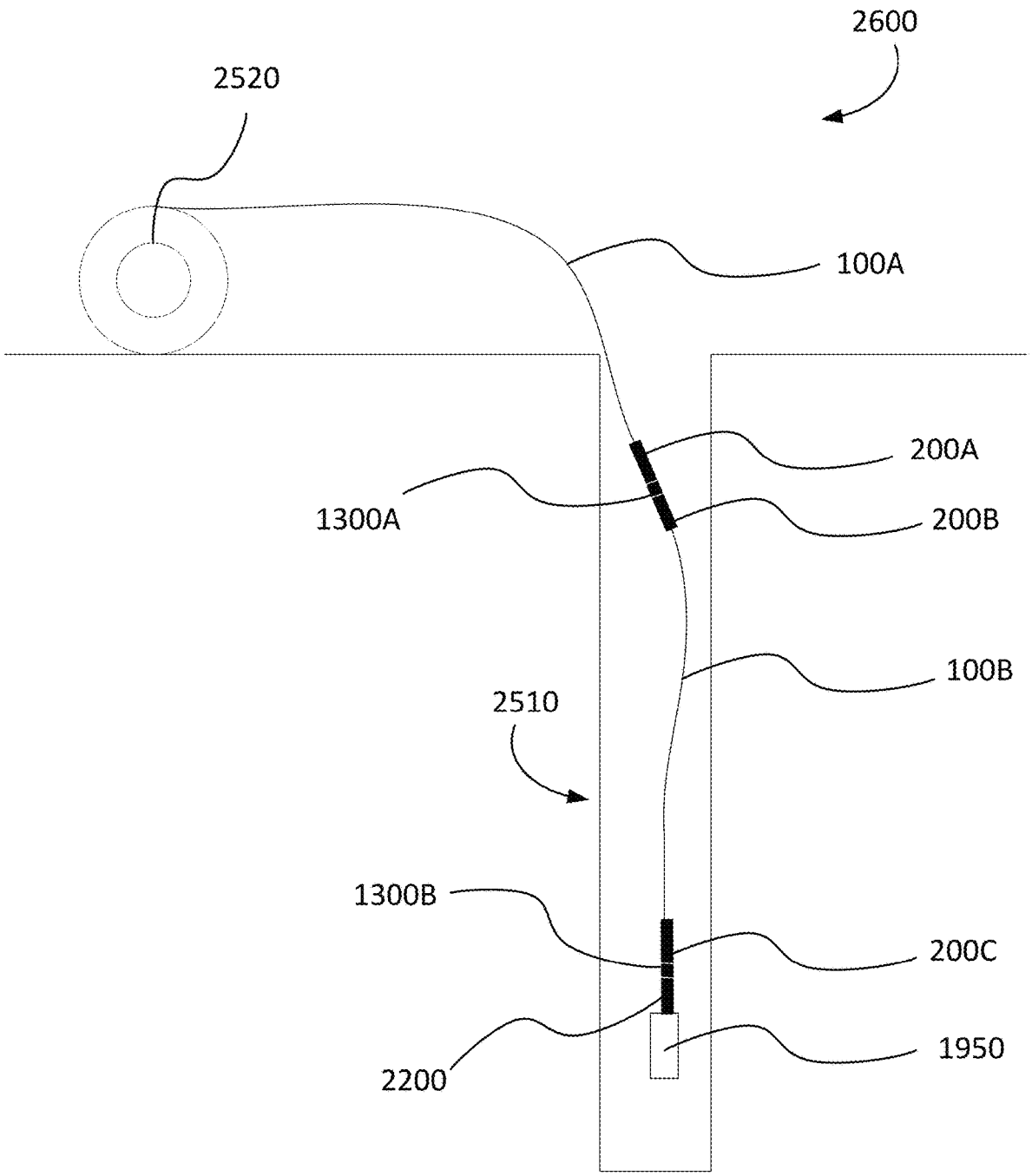
FIG. 26 illustrates another example drilling system, according to one or more embodiments.

FIG. 26 illustrates an example system 2600 at least partially locatable in a well 2510, including a coiled tubing reel 2520 of sections of coiled tubing 100, a first coiled tubing section 100A having a first male connector 200A, connected to a second coiled tubing section 100B having a second male connector 200B and a third male connector 200C, a first female tubing crossover 1300A, a second female tubing crossover 1300B, and a BHA 1950 having a BHA male connector 2200. The first male connector 200A and the second male connector 200B are connected with the first female tubing crossover 1300A, thus facilitating fluid communication and electrical connection between the first coiled tubing section 100A and the second coiled tubing section 100B. The third male connector 200C is mated to the second female tubing crossover 1300B and the second female tubing crossover 1300B is also connected with the BHA male connector 2200, thus facilitating fluid communication and electrical connection between the first coiled tubing section 100A, the second coiled tubing section 100B, and the BHA 1950. The example system 2600 is an alternate configuration of the example system 2500 capable of executing the same functions, where the connection into the BHA is provided by a BHA male connector 2200 as opposed to a BHA female connector 1900 of example system 2500.

Examples of the above aspects include:

Example 1 is a coiled tubing system, comprising: sections of coiled tubing, each section including a tubing internal bore, a section of electrical cable extending within the tubing internal bore, and at least one electrical male wet stab connector ("male connector"), each male connector comprising an anchor comprising a male fluid pathway in fluid communication with the tubing internal bore and configured to secure the electrical cable such that the electrical cable is isolated from the male fluid pathway; and a female tubing crossover configured to connect two of the sections of coiled tubing, comprising: a female fluid pathway; and electrical female wet stab connectors ("female connector"), each configured to receive a respective male connector to establish an electrical connection with the electrical cable that is isolated from the female fluid pathway, wherein the female connectors are electrically connected, wherein each respective male fluid pathway and the female fluid pathway are in fluid communication when the female tubing crossover is connecting two sections of the coiled tubing to provide fluid communication between the sections of coiled tubing.

Example 2 includes all the previous examples wherein a continuous electrical connection and a continuous fluid pathway are provided by two sections of the coiled tubing and the female tubing crossover such that the continuous electrical connection and the continuous fluid pathway are physically isolated from one another.

Example 3 includes all the previous examples wherein each male connector further includes a male housing, and each anchor is configured to be secured within each male housing via at least one of fasteners, a threaded external surface of the anchor interfacing with a threaded portion of a male housing internal bore, or an interference fit between an external surface of the anchor and an internal surface of the male housing.

Example 4 includes all the previous examples wherein each male connector further includes a male housing, wherein the male fluid pathway is defined between an external surface of the anchor and an internal bore of the male housing.

Example 5 includes all the previous examples wherein the male fluid pathway is defined by at least one internal fluid bore extending through the anchor, distinct from an anchor internal bore through which the electrical cable is extendable.

Example 6 includes all the previous examples further comprising a bottom hole assembly ("BHA"), connectable with the female tubing crossover, comprising an affixed male connector establishing a BHA male fluid pathway, wherein the BHA male fluid pathway is in fluid communication with the female fluid pathway when the BHA is connected with the female tubing crossover.

Example 7 includes all the previous examples further comprising a bottom hole assembly ("BHA"), connectable with one of the male connectors, comprising an affixed female connector establishing a BHA female fluid pathway, wherein the BHA female fluid pathway is in fluid communication with the male fluid pathway when the BHA is connected with the male connector.

Example 8 is a method of connecting coiled tubing sections, comprising: connecting sections of coiled tubing by connecting female tubing crossovers between sections of the coiled tubing, each section of coiled tubing including a section of electrical cable extending therethrough; establishing a continuous electrical connection between the sections of the electrical cable by electrical wet stab connections between the sections of coiled tubing and the female tubing crossover; and establishing a continuous fluid pathway between the sections of coiled tubing by establishing fluid communication between fluid pathways in the sections of coiled tubing and in the female tubing crossover.

Example 9 includes all the previous examples further comprising physically isolating the continuous electrical connection and the continuous fluid pathway.

Example 10 includes all the previous examples further comprising connecting a bottom hole assembly ("BHA") to one of the sections of the coiled tubing by an electrical wet stab connection between the one of the sections of the coiled tubing and the BHA to continue the continuous electrical connection and the continuous fluid pathway with the BHA.

Example 11 includes all the previous examples further comprising physically isolating the continuous electrical connection and the continuous fluid pathway with the BHA.

Example 12 includes all the previous examples further comprising connecting a bottom hole assembly ("BHA") to one of the sections of the coiled tubing by an electrical wet stab connection between a female tubing crossover and the BHA to continue the continuous electrical connection and the continuous fluid pathway with the BHA.

Example 13 includes all the previous examples further comprising physically isolating the continuous electrical connection and the continuous fluid pathway with the BHA.

Example 14 is a drilling system, comprising: sections of coiled tubing, each section including a tubing internal bore, a section of electrical cable extending within the tubing internal bore, and at least one electrical male wet stab connector ("male connector"), each male connector comprising an anchor comprising a male fluid pathway in fluid communication with the tubing internal bore and configured to secure the electrical cable such that the electrical cable is isolated from the male fluid pathway; a female tubing crossover configured to connect two of the sections of coiled tubing, comprising: a female fluid pathway; and electrical female wet stab connectors ("female connector"), each configured to receive a respective male connector to establish an electrical connection with the electrical cable that is isolated from the female fluid pathway, wherein the female connectors are electrically connected, wherein each respective male fluid pathway and the female fluid pathway are in fluid communication when the female tubing crossover is connecting two sections of the coiled tubing to provide fluid communication between the sections of coiled tubing; and a bottom hole assembly ("BHA") comprising a BHA connector.

Example 15 includes all the previous examples wherein the BHA connector comprises a male connector connectable to the female tubing crossover to establish a BHA male fluid pathway in fluid communication with the female fluid pathway when the BHA connector is connected to the female tubing crossover.

Example 16 includes all the previous examples wherein a continuous electrical connection and a continuous fluid pathway are provided when a section of the coiled tubing is connected to a female tubing crossover that is connected to the BHA connector such that the continuous electrical connection and the continuous fluid pathway are physically isolated from one another.

Example 17 includes all the previous examples wherein the BHA connector comprises a female connector connectable to one of the male connectors to establish a BHA female fluid pathway in fluid communication with the male fluid pathway when the BHA connector is connected to the male connector.

Example 18 includes all the previous examples wherein a continuous electrical connection and a continuous fluid pathway are provided when a section of the coiled tubing is connected to the BHA connector such that the continuous electrical connection and the continuous fluid pathway are physically isolated from one another.

Example 19 includes all the previous examples The system of claim 14, wherein each male connector further includes a male housing, wherein the male fluid pathway is defined between an external surface of the anchor and an internal bore of the male housing.

Example 20 includes all the previous examples wherein the male fluid pathway is defined by at least one internal fluid bore extending through the anchor, distinct from an anchor internal bore through which the electrical cable is extendable.

Certain terms are used throughout the description and claims to refer to particular features or components. As one skilled in the art will appreciate, different persons may refer to the same feature or component by different names. This document does not intend to distinguish between components or features that differ in name but not function.

As used herein, "about," "approximately" and "substantially" are understood to refer to numbers in a range of the referenced number, for example the range of −10% to +10% of the referenced number, preferably −5% to +5% of the referenced number, more preferably −1% to +1% of the referenced number, most preferably −0.1% to +0.1% of the referenced number.

Furthermore, all numerical ranges herein should be understood to include all integers, whole numbers, or fractions, within the range. Moreover, these numerical ranges should be construed as providing support for a claim directed to any number or subset of numbers in that range. For example, a disclosure of from 1 to 10 should be construed as supporting a range of from 1 to 8, from 3 to 7, from 1 to 9, from 3.6 to 4.6, from 3.5 to 9.9, and so forth.

As used in the present disclosure, a phrase referring to "at least one of" a list of items refers to any set of those items, including sets with a single member, and every potential combination thereof. For example, when referencing "at least one of A, B, or C" or "at least one of A, B, and C", the phrase is intended to cover the sets of: A, B, C, A-B, B-C, and A-B-C, where the sets may include one or multiple instances of a given member (e.g., A-A, A-A-A, A-A-B, A-A-B-B-C-C-C, etc.) and any ordering thereof. For avoidance of doubt, the phrase "at least one of A, B, and C" shall not be interpreted to mean "at least one of A, at least one of B, and at least one of C".

As used in the present disclosure, the term "determining" encompasses a variety of actions that may include calculating, computing, processing, deriving, investigating, looking up (e.g., via a table, database, or other data structure), ascertaining, receiving (e.g., receiving information), accessing (e.g., accessing data in a memory), retrieving, resolving, selecting, choosing, establishing, and the like.

Without further elaboration, it is believed that one skilled in the art can use the preceding description to use the claimed inventions to their fullest extent. The examples and aspects disclosed herein are to be construed as merely illustrative and not a limitation of the scope of the present disclosure in any way. It will be apparent to those having skill in the art that changes may be made to the details of the above-described examples without departing from the underlying principles discussed. In other words, various modifications and improvements of the examples specifically disclosed in the description above are within the scope of the appended claims. For instance, any suitable combination of features of the various examples described is contemplated.

Within the claims, reference to an element in the singular is not intended to mean "one and only one" unless specifically stated as such, but rather as "one or more" or "at least one". Unless specifically stated otherwise, the term "some" refers to one or more. No claim element is to be construed under the provision of 35 U.S.C. § 112(f) unless the element is expressly recited using the phrase "means for" or "step for". All structural and functional equivalents to the elements of the various embodiments described in the present disclosure that are known or come later to be known to those of ordinary skill in the relevant art are expressly incorporated herein by reference and are intended to be encompassed by the claims. Moreover, nothing disclosed in the present disclosure is intended to be dedicated to the public regardless of whether such disclosure is explicitly recited in the claims.

The invention is claimed as follows:

1. A coiled tubing system, comprising:

sections of coiled tubing, each section including a tubing internal bore, a section of electrical cable extending within the tubing internal bore and attached at each end to an electrical male wet stab connector ("male connector"), each male connector comprising an anchor comprising a male fluid pathway in fluid communication with the tubing internal bore and configured to secure the electrical cable such that the electrical cable is isolated from the male fluid pathway; and a female tubing crossover configured to connect two of the sections of coiled tubing, comprising:

a female fluid pathway; and electrical female wet stab connectors ("female connectors") at each end, each configured to receive a respective male connector to establish an electrical connection with the electrical cable that is isolated from the female fluid pathway, wherein the female connectors are electrically connected, wherein each respective male fluid pathway and female fluid pathway are in fluid communication when the female tubing crossover is connecting two sections of the coiled tubing to provide fluid communication between the sections of coiled tubing.

2. The coiled tubing system of claim 1, wherein a continuous electrical connection and a continuous fluid pathway are provided by two sections of the coiled tubing and the female tubing crossover such that the continuous electrical connection and the continuous fluid pathway are physically isolated from one another.

3. The coiled tubing system of claim 1, wherein each male connector further includes a male housing, and each anchor is configured to be secured within each male housing via at least one of fasteners, a threaded external surface of the anchor interfacing with a threaded portion of a male housing internal bore, or an interference fit between an external surface of the anchor and an internal surface of the male housing.

4. The coiled tubing system of claim 1, wherein each male connector further includes a male housing, wherein the male fluid pathway is defined between an external surface of the anchor and an internal bore of the male housing.

5. The coiled tubing system of claim 1, wherein the male fluid pathway is defined by at least one internal fluid bore extending through the anchor, distinct from an anchor internal bore through which the electrical cable is extendable.

6. The coiled tubing system of claim 1, further comprising a bottom hole assembly ("BHA"), connectable with the female tubing crossover, comprising an affixed male connector establishing a BHA male fluid pathway, wherein the BHA male fluid pathway is in fluid communication with the female fluid pathway when the BHA is connected with the female tubing crossover.

7. The coiled tubing system of claim 1, further comprising a bottom hole assembly ("BHA"), connectable with one of the male connectors, comprising an affixed female connector establishing a BHA female fluid pathway, wherein the BHA female fluid pathway is in fluid communication with the male fluid pathway when the BHA is connected with the male connector.

8. A method of connecting coiled tubing sections, comprising:

connecting sections of coiled tubing by connecting female tubing crossovers between sections of the coiled tubing, each section of coiled tubing including a section of electrical cable extending therethrough and attached at each end to an electrical male wet stab connector ("male connector") and each female tubing crossover including electrical female wet stab connectors ("female connectors") at each end;

establishing a continuous electrical connection between the sections of the electrical cable by connecting the male connectors of the sections of coiled tubing to the female connectors of the female tubing crossovers; and establishing a continuous fluid pathway between the sections of coiled tubing by establishing fluid communication between fluid pathways in the sections of coiled tubing, the male connectors, and the female tubing crossovers.

9. The method of claim 8, further comprising physically isolating the continuous electrical connection and the continuous fluid pathway.

10. The method of claim 8, further comprising connecting a bottom hole assembly ("BHA") to one of the sections of the coiled tubing by an electrical wet stab connection between the one of the sections of the coiled tubing and the BHA to continue the continuous electrical connection and the continuous fluid pathway with the BHA.

11. The method of claim 10, further comprising physically isolating the continuous electrical connection and the continuous fluid pathway with the BHA.

12. The method of claim 8, further comprising connecting a bottom hole assembly ("BHA") to one of the sections of the coiled tubing by an electrical wet stab connection between a female tubing crossover and the BHA to continue the continuous electrical connection and the continuous fluid pathway with the BHA.

13. The method of claim 12, further comprising physically isolating the continuous electrical connection and the continuous fluid pathway with the BHA.

14. A drilling system, comprising:

sections of coiled tubing, each section including a tubing internal bore, a section of electrical cable extending within the tubing internal bore and attached at each end to an electrical male wet stab connector ("male connector"), each male connector comprising an anchor comprising a male fluid pathway in fluid communication with the tubing internal bore and configured to secure the electrical cable such that the electrical cable is isolated from the male fluid pathway;

a female tubing crossover configured to connect two of the sections of coiled tubing, comprising:

a female fluid pathway; and electrical female wet stab connectors ("female connectors") at each end, each configured to receive a respective male connector to establish an electrical connection with the electrical cable that is isolated from the female fluid pathway, wherein the female connectors are electrically connected, wherein each respective male fluid pathway and the female fluid pathway are in fluid communication when the female tubing crossover is connecting two sections of the coiled tubing to provide fluid communication between the sections of coiled tubing; and a bottom hole assembly ("BHA") comprising a BHA connector.

15. The system of claim 14, wherein the BHA connector comprises a male connector connectable to the female tubing crossover to establish a BHA male fluid pathway in fluid communication with the female fluid pathway when the BHA connector is connected to the female tubing crossover.

16. The system of claim 15, wherein a continuous electrical connection and a continuous fluid pathway are provided when a section of the coiled tubing is connected to a female tubing crossover that is connected to the BHA connector such that the continuous electrical connection and the continuous fluid pathway are physically isolated from one another.

17. The system of claim 14, wherein the BHA connector comprises a female connector connectable to one of the male connectors to establish a BHA female fluid pathway in fluid communication with the male fluid pathway when the BHA connector is connected to the male connector.

18. The system of claim 17, wherein a continuous electrical connection and a continuous fluid pathway are provided when a section of the coiled tubing is connected to the BHA connector such that the continuous electrical connection and the continuous fluid pathway are physically isolated from one another.

19. The system of claim 14, wherein each male connector further includes a male housing, wherein the male fluid pathway is defined between an external surface of the anchor and an internal bore of the male housing.

20. The system of claim 14, wherein the male fluid pathway is defined by at least one internal fluid bore extending through the anchor, distinct from an anchor internal bore through which the electrical cable is extendable.

* * * * *